US010036373B2

(12) United States Patent
Loewen et al.

(10) Patent No.: US 10,036,373 B2
(45) Date of Patent: Jul. 31, 2018

(54) THERMAL PUMPING VIA IN SITU PIPES AND APPARATUS INCLUDING THE SAME

(71) Applicants: Eric P. Loewen, Wilmington, NC (US); Brian S. Hunt, Wilmington, NC (US)

(72) Inventors: Eric P. Loewen, Wilmington, NC (US); Brian S. Hunt, Wilmington, NC (US)

(73) Assignee: GE-HITACHI NUCLEAR ENERGY AMERICAS LLC, Wilmington, NC (US)

( * ) Notice: Subject to any disclaimer, the term of this patent is extended or adjusted under 35 U.S.C. 154(b) by 469 days.

(21) Appl. No.: 14/203,924

(22) Filed: Mar. 11, 2014

(65) Prior Publication Data

US 2015/0260173 A1 Sep. 17, 2015

(51) Int. Cl.
*F04B 19/24* (2006.01)

(52) U.S. Cl.
CPC ..... *F04B 19/24* (2013.01); *Y10T 29/49236* (2015.01)

(58) Field of Classification Search
CPC ..... F04B 19/24; F04B 19/006; F04B 43/043; F04B 23/08; F04B 49/03; F04B 49/10; Y10T 29/49236; Y10T 137/1714; Y10T 137/1722; Y10T 137/1729; Y10T 137/1737; B23P 15/26; F16K 17/16; F16K 17/1606; F16K 17/162
USPC ..... 417/244, 251, 207–209
See application file for complete search history.

(56) References Cited

U.S. PATENT DOCUMENTS 3,052,228 A * 9/1962 Okuda ..... F16K 21/18 126/590
3,626,148 A * 12/1971 Woytowich ..... F02N 19/10 123/142.5 E
3,659,960 A * 5/1972 Dunlop ..... F17D 1/16 417/209
3,870,063 A * 3/1975 Hayward ..... F17D 1/16 137/13

(Continued)

FOREIGN PATENT DOCUMENTS

EP 0486528 A1 5/1992
EP 0486528 B1 * 3/1994 ..... F04F 1/10

(Continued)

OTHER PUBLICATIONS

NPL, Pacific Texas Pipeline Project (PTPP), Nov. 1985, filed named 14203924—Pacific Texas Pipeline Project (PTPP)—Nov. 1985.*

*Primary Examiner* — Charles Freay
*Assistant Examiner* — Jon Hoffmann
(74) *Attorney, Agent, or Firm* — Harness, Dickey & Pierce, P.L.C.

(57) ABSTRACT

A thermal-pumping apparatus according to a non-limiting example embodiment may include a first volume structure defining a first inlet opening and a first outlet opening in fluid communication with a first volume, a second volume structure defining a second inlet opening and a second outlet opening in fluid communication with a second volume, and a connection structure joining the first outlet opening of the first volume structure to the second inlet opening of the second volume structure. The connection structure may include a one-directional valve configured to allow fluid flow between the first and second volume structures in one direction only from the first volume of the first volume structure to the second volume of the second volume structure.

21 Claims, 13 Drawing Sheets

(56) References Cited

U.S. PATENT DOCUMENTS 3,898,017 A * 8/1975 Mandroian ..... F04B 19/24 417/209
3,929,305 A * 12/1975 Sabol ..... B64D 13/00 165/104.22
3,969,605 A * 7/1976 Danell ..... F02N 19/10 123/142.5 E
4,028,008 A * 6/1977 Shelton ..... F03G 6/00 126/634
4,036,209 A * 7/1977 Press ..... F24J 2/201 126/626
4,182,307 A * 1/1980 Brindle ..... F24J 2/204 126/625
4,299,200 A * 11/1981 Spencer ..... F24J 2/4634 126/584
4,384,568 A * 5/1983 Palmatier ..... F24D 11/003 126/589
4,431,385 A * 2/1984 O'Hare ..... F04B 19/24 417/209
4,439,111 A 3/1984 Seidel et al.
4,485,804 A * 12/1984 Sharpe ..... F24J 2/4627 126/625
4,640,667 A * 2/1987 Trepp ..... F04F 99/00 417/207
4,686,960 A * 8/1987 Kleinwachter ..... F24D 17/0021 126/585
5,163,821 A 11/1992 Kelly et al.
5,242,272 A 9/1993 Ven et al.
5,415,033 A * 5/1995 Maresca, Jr. ..... G01M 3/2807 73/40.5 R
5,511,954 A * 4/1996 Han ..... F04F 1/04 417/121
5,881,801 A * 3/1999 Hayakawa ..... F02G 1/00 165/104.24
6,026,839 A * 2/2000 Kriebel ..... F16L 53/002 137/13
6,105,942 A * 8/2000 Kurzer ..... A23L 2/54 261/119.1
6,240,948 B1 * 6/2001 Hansen, III ..... F16K 17/1606 137/68.19
7,798,140 B2 9/2010 van Houten
8,312,889 B2 11/2012 Oltman et al.
8,469,676 B2 * 6/2013 Sutherland ..... F04B 53/162 417/207
2003/0185688 A1 * 10/2003 Han ..... F04B 9/113 417/329
2003/0192693 A1 * 10/2003 Wellington ..... E21B 41/0064 166/267
2005/0235584 A1 * 10/2005 Farwell ..... F16K 17/16 52/202
2005/0247349 A1 * 11/2005 Barrows ..... F16K 15/03 137/527.4
2006/0076062 A1 * 4/2006 Andersson ..... F16K 15/063 137/512
2007/0131280 A1 * 6/2007 Ochiai ..... F16K 27/08 137/454.2
2008/0017499 A1 * 1/2008 Brockhoff ..... B01D 3/346 203/11
2009/0007787 A1 * 1/2009 Wright ..... B01D 53/268 96/4
2009/0166034 A1 * 7/2009 Mundell ..... E21B 43/12 166/250.15
2011/0061643 A1 * 3/2011 Bohl ..... F24J 2/14 126/573
2011/0192568 A1 * 8/2011 Hsieh ..... H05K 7/20927 165/48.1
2011/0231024 A1 * 9/2011 Medizade ..... F04B 49/065 700/282
2011/0311014 A1 * 12/2011 Hottovy ..... B01J 19/1837 376/283
2012/0012571 A1 * 1/2012 Modena ..... B23K 26/364 219/121.72
2013/0129485 A1 5/2013 Kucuk

FOREIGN PATENT DOCUMENTS

EP 0802358 A2 10/1997
EP 2085975 A1 8/2009
WO WO-9533926 A2 12/1995
WO WO-0111243 A1 2/2001

* cited by examiner

THERMAL PUMPING VIA IN SITU PIPES AND APPARATUS INCLUDING THE SAME

BACKGROUND

Field

The present disclosure relates to thermal pumping via in situ pipes and/or an apparatus including the same.

Description of Related Art

Pipes and pumping systems may be used to move fluids such as water between a source and point of use. The number of pumps in a pumping system can increase the capital costs for building a pumping system. The number of pumps in a pumping system may also increase operational costs for a pumping system.

Additionally, infrastructure such as fossil fuel power plants and power lines for to generating and delivering electricity the electricity to electrically-powered pumps may contribute to the costs of a pumping system including electrically-powered pumps. In a remote area, the costs associated with providing the infrastructure for a pumping system having electrically-powered pumps may be higher compared to an area with an existing infrastructure.

Accordingly, a pumping system that reduces and/or minimizes the number of pumps required may be desired.

SUMMARY

Some example embodiments relate to a thermal-pumping apparatus.

Other example embodiments relate to a method of manufacturing a thermal-pumping apparatus.

Yet, other example embodiments relate to a method of operating a thermal-pumping apparatus.

According to an example embodiment, a thermal-pumping apparatus may include a first volume structure, a second volume structure, and a connection structure. The first volume structure defines a first volume. The first volume structure defines a first inlet opening and a first outlet opening in fluid communication with the first volume. The second volume structure defines a second volume. The second volume structure defines a second inlet opening and a second outlet opening in fluid communication with the second volume. The connection structure joins the first outlet opening of the first volume structure to the second inlet opening of the second volume structure. The connection structure includes a one-directional valve configured to allow fluid flow between the first and second volume structures in one direction only from the first volume of the first volume structure to the second volume of the second volume structure.

The thermal-pumping apparatus may further include at least one disc independently connected to a corresponding one of the first and second volume structures through a pipe portion. The disc may be configured to relieve an internal pressure of the corresponding one of the first and second volume structures if the internal pressure of the corresponding one of the first and second volume structures bursts the disc.

The thermal-pumping apparatus may further include a heat transfer structure configured to supply thermal energy to the first volume structure and to increase a pressure in the first volume of the first volume structure.

The first and second volume structure may be pipes. The connection structure may include a flange joining one end of the first volume structure to one end of the second volume structure. The one-directional valve may be one of surrounded by the first volume structure, surrounded by the second volume structure, and at an interface between the first and second volume structures.

At least one an electrically-powered pump and a mechanically-powered pump may be not directly connected to the second volume structure and may not be configured to increase a pressure in the second volume of the second volume structure.

The thermal-pumping apparatus may further include a distributed control and information system (DCIS). The DCIS may include a first volume structure sensor, a second volume structure sensor, and a connection structure sensor. A bottom surface of the first volume structure may define the first outlet opening. The connection structure may include an equalizing line connected to the one-directional valve and the second inlet opening of the second volume structure. The equalizing line may be configured to allow fluid flow from the first volume of the first volume structure through the one-directional valve to the second volume of the second volume structure if the one-directional valve is open. The first volume structure sensor may be configured to measure at least one of a temperature, level, and a pressure of fluid in the first volume structure. The second volume structure sensor may be configured to measure at least one of a temperature, level, and a pressure of fluid in the second volume structure. The connection structure sensor may be configured to measure a flow rate of fluid through the equalizing line.

The thermal-pumping apparatus may further include at least one exhaust valve connected to a corresponding one of the first and second volume structures. The corresponding one of the first and second volume structures may define an exhaust opening. The exhaust valve may be connected to the exhaust opening. The DCIS may be configured to open the exhaust valve in order to provide a path for air or gas to escape from or enter the corresponding one of the first and second volume structures.

The thermal-pumping apparatus may further include a bypass valve. The first volume structure may define a first bypass opening in fluid communication with the first volume. The equalizing line may define a first bypass hole. The bypass valve may be configured to selectively allow fluid flow from the first volume of the first volume structure through the first bypass hole into the equalizing line.

The one-directional valve may be configured to open if a pressure of the first volume is greater than a pressure of the second volume, and a differential pressure between the first volume and the second volume is greater than or equal to a threshold of the one-directional valve. The one-directional valve may be configured to close if the differential pressure between the first volume and the second volume is less than the threshold of the one-directional valve. The one-directional valve may also be configured to close if the pressure of the first volume is less than the pressure of the second volume.

The thermal-pumping apparatus may further include a plurality of volume structures, a plurality of connection structures, and at least one input pipe connected to the first inlet opening of the first volume structure. The plurality of volume structures may include the first and second volume structures. The plurality of connections structures may connect the plurality of volume structures in series. The plurality of connection structures may include the connection structure joining the first outlet opening of the first volume to the second inlet opening of the second volume structure.

At least one of an electrically-powered pump and a mechanically-powered pump may not be directly connected to the second volume structure and may not be configured to increase a pressure in the second volume of the second volume structure. The plurality of volume structures may be a plurality of pipes. The plurality of connection structures may include flanges connecting the plurality of pipes end-to-end in series.

The thermal-pumping apparatus may further include discs. Each one of the discs may be independently connected to a corresponding one of the plurality of volume structures through respective pipe portions and configured to relieve an internal pressure of the corresponding one of the plurality of volume structures if the internal pressure of the corresponding one of the plurality of volume structures bursts the one of the discs.

According to an example embodiment, a method of manufacturing a thermal-pumping apparatus may include connecting a first volume structure to a second volume structure with a connection structure. The first volume structure defines a first volume. The first volume structure defines a first inlet opening and a first outlet opening in fluid communication with the first volume. The second volume structure defines a second volume. The second volume structure defines a second inlet opening and a second outlet opening in fluid communication with the second volume. The connection structure joins the first outlet opening of the first volume structure to the second inlet opening of the second volume structure. The connection structure includes a one-directional valve configured to allow fluid flow between the first and second volume structures in one direction only from the first volume of the first volume structure to the second volume of the second volume structure.

The method may further include connecting at least one of a disc and a heat transfer structure to a corresponding one of the first and second volume structures. The disc may be connected to the corresponding one of the first and second volume structures through a pipe portion. The disc may be configured to relieve an internal pressure of the corresponding one of the first and second volume structures if the internal pressure of the corresponding one of the first and second volume structures bursts the disc. The heat transfer structure may be configured to supply thermal energy to the corresponding one of the first and second volume structures and to increase a pressure in the corresponding one of the first and second volume structures.

The connecting the first volume structure to the second volume structure may further include connecting a plurality of volume structures to each other in series using a plurality of connection structures having one-directional valves. The plurality of volume structures may include the first and second volume structures. The plurality of connection structures may include the connection structure joining the first outlet opening of the first volume structure to the second inlet opening on the second volume structure. Each one of the one-directional valves may be one of surrounded by a corresponding one of the plurality of connection structures and at an interface between two of the plurality of connections structures. At least one of an electrically-powered pump and a mechanically-powered pump may not be directly connected to the first volume structure and may not be configured to increase a pressure in the first volume of the first volume structure.

The method may further include connecting a distributed control and information system (DCIS) to the first volume structure, the connection structure, and the second volume structure. The DCIS may include a first volume structure sensor, a second volume structure sensor, and a connection structure sensor. A bottom surface of the first volume structure may define the first outlet opening. The connection structure may include an equalizing line. The connecting the first volume structure to the second volume structure with the connection structure may include connecting the equalizing line to the one-directional valve and the second inlet opening of the second volume structure. The equalizing line may be configured to allow fluid flow from the first volume of the first volume structure through the one-directional valve to the second volume of the second volume structure if the one-directional valve is open. The first volume structure sensor may be configured to measure at least one of a temperature, level, and a pressure of fluid in the first volume structure. The second volume structure sensor may be configured to measure at least one of a temperature, level, and a pressure of fluid in the second volume structure. The connection structure sensor may be configured to measure a flow rate of fluid through the equalizing line.

According to an example embodiment, a method of operating a thermal-pumping apparatus including first to Nth volume structures serially-connected to each other and respective one-directional valves controlling fluid flow between adjacent volume structures may include thermally-pumping a fluid from the first volume structure through a first one-directional valve to the second volume structure, based on using thermal energy to activate the first one-directional valve. The one-directional valves may include the first one-directional valve between the first and second volume structures.

The thermally-pumping may further include increasing a pressure in the first volume structure using the thermal energy, opening the first one-directional valve if the pressure in the first volume structure is greater than a pressure in the second volume structure and a differential pressure between the first volume structure and the second volume structure is greater than or equal to a threshold of the first one-directional valve, and closing the first one-directional valve. The first one-directional valve may be closed if at least one of the differential pressure between the first and second volume structures is less than the threshold of the first one-directional valve, and the pressure in the first volume structure is less than the pressure in the second volume structure.

The thermally-pumping may include at least one of thermally pumping a liquid phase of the fluid through the first and second volume structures, thermally pumping a vapor phase of the fluid through the first and second volume structures, and thermally pumping a mixed liquid and vapor phase of the fluid through the first and second volume structures.

The method may further include thermally pumping the fluid from the second volume structure to the Nth volume structure based on using thermal energy to activate the one-directional valves between the second volume structure and the Nth volume structure.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
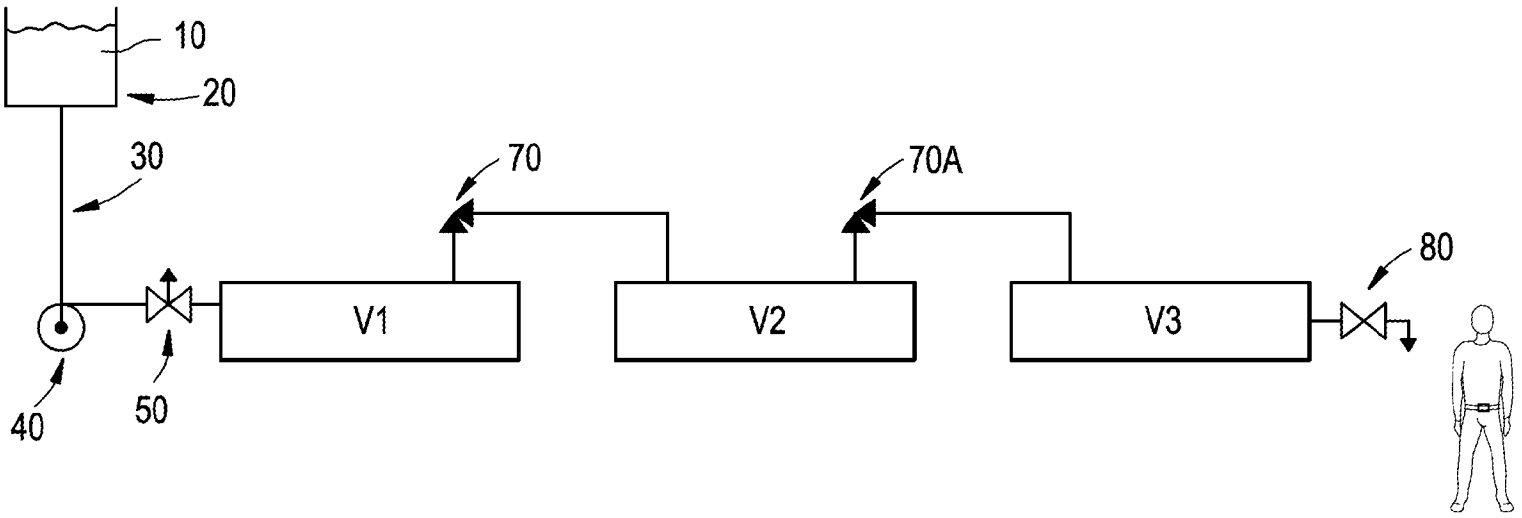
FIG. 1 is an illustration of a pressure conveyance system according to an example embodiment.

Example embodiments will now be described more fully with reference to the accompanying drawings, in which some example embodiments are shown. Example embodiments, may, however, be embodied in many different forms and should not be construed as being limited to the embodiments set forth herein; rather, these example embodiments are provided so that this disclosure will be thorough and complete, and will fully convey the scope of example embodiments to those of ordinary skill in the art. In the drawings, like reference numerals in the drawings denote like elements, and thus their description may be omitted.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1 is an illustration of a pressure conveyance system according to an example embodiment.

Referring to FIG. 1, a pressure conveyance system may include three control volumes V1, V2, and V3. Each one of the control volumes V1, V2, and V3 may define an inlet opening, an outlet opening, and a volume in fluid communication with the inlet opening and the outlet opening. The control volumes V1, V2, and V3 may be volume structures such as pipes, but example embodiments are not limited thereto. When the control volumes V1, V2, and V3 are pipes, the volumes defined by the control volumes V1, V2, and V3 may be the inner hollow portion of the pipe along a longitudinal direction. Each one of the control volumes V1, V2, and V3 may define an inlet opening and an outlet opening in fluid communication with the volume of the control volumes V1, V2, and V3.

In the pressure conveyance system, fluid 10 from a source such as a tank 20 may be transported through a pipe 30 to the inlet of a pump 40. The fluid 10 may be water, but is not limited thereto. The source is not limited to being the tank 20. The pump 40 may provide energy input to raise the pressure of the fluid 10 and transport the fluid 10 through a control valve 50 to enter the first control volume V1. In other words, the pump 40 may pump the fluid 10 through the control valve 50 into the first control volume V1.

Each one of the control volumes V1, V2, and V3 may be connected to an adjacent one of the control volumes V1, V2, and V3 through a connection structure. Each connection structure may join the outlet opening of one of the control volumes V1, V2, and V3, to the inlet opening of a different one of the control volumes V1, V2, and V3. For example, the connection structure between the first and second control volumes V1 and V2 may include a pipe and a relief valve 70 that join the outlet opening of the first control volume V1 to the inlet opening of the second control volume V2. A pipe and relief valve 70A may join the second and third control volumes V2 and V3. The relief valves 70, 70A may be one-directional valves. For example, the relief valve 70 may be a one-directional valve that only allows fluid to flow from the first control volume V1 to the second control volume V2. The relief valve 70A may be a one-directional valve that only allows fluid to flow from the second control volume V2 to third control volume V3.

The fluid 10 may fill the first control volume V1 until the pressure inside the first control volume V1 reaches a sufficient pressure to open the relief valve 70. For example, the relief valve 70 may be configured to open so the fluid 10 flows from the first control volume V1 to the second control volume V2 if the pressure of fluid 10 in the first control volume V1 is greater than the pressure of fluid in the second control volume V2, and if the differential pressure of fluid 10 in the first and second control volumes V1 and V2 is greater than or equal to a threshold (e.g., set point) of the relief valve 70. Heat can also be added to the fluid 10 while the fluid resides in the first control volume V1 to increase the pressure of the fluid 10 in the first control volume V1.

When the relief valve 70 opens, the fluid 10 may move from the first control volume V1 through the relief valve 70 to the second control volume V2 if the pressure in the first control volume V1 is greater than the pressure in the second control volume V2. Flow of the fluid 10 from the first control volume V1 to the second control volume V2 may continue as long as the first control volume V1 has an adequate fluid supply and as long as relief valve 70 is open. Conversely, flow of the fluid 10 from the first control volume V1 to the second control volume V2 may stop if the relief valve 70 closes. The relief valve 70 may close if the pressure of the fluid 10 in the first control volume V1 is less than the pressure of the fluid 10 in the second control volume V2 and/or if the differential pressure between the first and second control volumes V1 and V2 is less than a threshold of the relief valve 70.

Additionally, flow of the fluid 10 from the first control volume V1 to the second control volume V2 may stop if the fluid supply in the first control volume V1 is not sufficient. However, the pump 40 may be used to transport more fluid 10 from the source 20 through the pipe 30 and control valve 50 into the first control volume V1 to ensure the fluid supply in the first control volume V1 is sufficient and/or to ensure the first control volume V1 does not become empty.

The control valve 50 may be set to open based on a threshold corresponding to a differential pressure between the pump 40 outlet and the pressure of fluid 10 in the first control volume V1. Accordingly, if fluid 10 in the first control volume V1 is thermally-pumped from the first control volume V1 to the second control volume V2, the pressure in the first control volume V1 may decrease. However, when the pressure in the first control volume V1 decreases, the differential pressure between the pump 40 outlet and the pressure in first control volume V1 may increase. When the differential pressure between the pump 40 outlet and first control volume V1 is greater than or equal to a threshold of the control valve 50, the control valve 50 may open and additional fluid 10 may be pumped into the first control volume V1.

When the fluid 10 flows from the first control volume V1 to the second control volume V2, the newly introduced fluid 10 in the second control volume V2 may come into thermal equilibrium with other fluid 10 in the second control volume V2. Thermal energy may be added to the fluid 10 in the second control volume V2. As thermal energy is added to the fluid 10 in the second control volume V2, the temperature of the fluid 10 in the second control volume V2 may increase. When the temperature of the fluid 10 in the second control volume V2 increases, the pressure of the fluid 10 in the second control volume V2 may also increase.

Equations (1) to (3) show the relationship between the volume, temperature, and pressure of the fluid 10 when the fluid is in the liquid phase.

$$V_1=V_o/(1+\beta\Delta T) \tag{1}$$

$$V_1=V_o/(1+\Delta P/\epsilon) \tag{2}$$

$$\Delta P=\epsilon\beta\Delta T \tag{3}$$

Although Equations (1) to (3) show the volume, temperature, and pressure relationship of the fluid 10 in the liquid phase, the fluid 10 flowing in the pressure conveyance system of FIG. 1 may be a liquid phase and/or a mixed liquid and gas phase in at least some portions. One of ordinary skill in the art would understand that gas laws could be applied to show the relationship between the volume, temperature, and pressure of the fluid 10 when at least a portion of the fluid 10 is in the gas phase.

In equation (1), $V_1$ and $V_o$ are the final and initial volumes, respectively, $\beta$ is the thermal expansion coefficient of the fluid 10, and $\Delta T$ is the change in temperature. For fixed volumes, such as when the fluid 10 fills the second control volume V2, the volume will not increase so equation (1) may be expressed as equation (2), where $\Delta P$ is the change of pressure and $\epsilon$ is the bulk modulus of the fluid 10. Accordingly, equation (3) may be derived from rearranging equations (1) and (2). Equation (3) shows the change in pressure of a fluid, $\Delta P$, may be proportional to the change in temperature of the fluid, $\Delta T$.

Based on the above-described principles, thermal energy may be used to increase the pressure of the fluid 10 in the second control volume V2 until the pressure of the fluid 10 reaches a sufficient pressure to open the relief valve 70A. For example, the relief valve 70A may be configured to open if the pressure of the fluid 10 in the second control volume V2 is greater than the pressure of the fluid 10 in the third control volume V3, and if the differential pressure of fluid 10 in the second and third control volumes V2 and V3 is greater than or equal to a threshold (e.g., set point) of the relieve valve 70A.

When the relief valve 70A opens, the fluid 10 may move from the second control volume V2 through the relief valve 70A to the third control volume V3 if the pressure in the second control volume V2 is greater than the pressure in the third control volume V3. Flow of the fluid 10 from the second control volume V2 to the third control volume V3 may continue as long as the second control volume V2 has an adequate fluid supply and as long as relief valve 70A is open. Conversely, flow of the fluid 10 from the second control volume V2 to the third control volume V3 may stop if the relief valve 70A is closed and/or if the pressure of fluid 10 in the second control volume V2 is less than the pressure of fluid 10 in the third control volume V3. The relief valve 70A may close if the pressure of the fluid 10 in the second control volume V2 is less than the pressure of the fluid 10 in the third control volume V3 and/or if the differential pressure between the second and third control volumes V2 and V3 is less than a threshold of the relief valve 70A.

When the fluid 10 flows in to the third control volume V3, an end user may collect the fluid by opening a valve 80 at the outlet opening of the third control volume V3.

Although FIG. 1 illustrates a pressure conveyance system that includes three control volumes V1 to V3 serially-connected to each other, those skilled in the art will see how the pressure conveyance system can be modified to include more than three control volumes. For example, a pressure conveyance according to an example embodiment may include hundreds and/or thousands of control volumes to convey a fluid (e.g., water) long distances to a point of use.

Similarly, one of ordinary skill in the art would recognize that the pressure conveyance system may be modified in various ways. For example, although illustrated, the fluid 10 may be supplied from a plurality of sources 20 through a plurality of pumps 40 via a plurality of pipes 30. In which case, the plurality of pumps 40 could supply the fluid through a plurality of control valves 50 to the first control volume V1. Also, although FIG. 1 illustrates one pipe and one relief valve 70 and 70A connecting each two control volumes, at least some of the control volumes may be connected by a plurality of relief valves (e.g., 70, 70A) and pipes. For example, the first control volume V1 may be connected to the second control volume V2 through a plurality of pipes that each include a relief valve 70.

Figure 2:
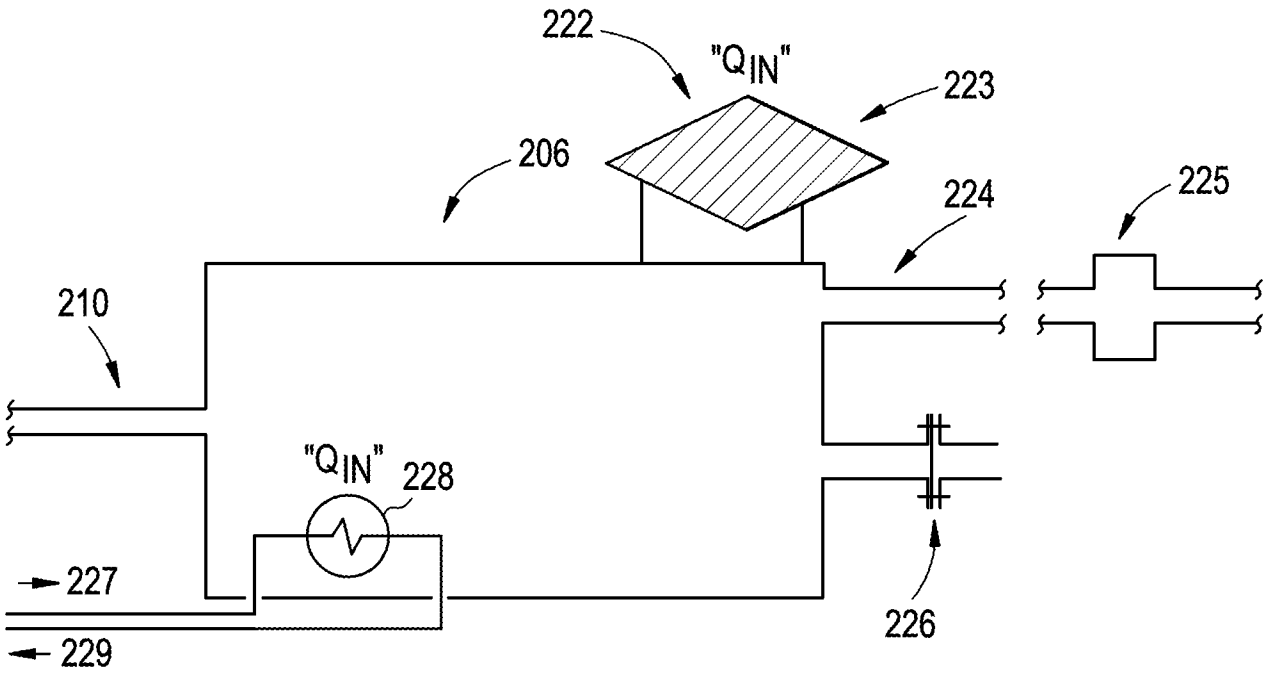
FIG. 2 is an illustration of details of a control volume according to an example embodiment.

FIG. 2 is an illustration of details of a control volume according to an example embodiment.

Referring to FIG. 2, a control volume 206 may be connected to a pipe 210 at one end. Fluid may enter the control volume 206 through the pipe 210. The pipe 210 may have a circumference and/or diameter that is significantly less than (e.g., less than 50% and/or less than 20% and/or less than 5%) the circumference and/or diameter of the control volume 206.

A plurality of heat input methods may be used to provide thermal energy to fluid in the control volume 206. For example, in one method, a heat exchanger 228 may be arranged to transfer thermal energy to the fluid in the control volume 206. The heat exchanger 228 may be positioned at least partially in the control volume 206 and/or include coils that wrap around the control volume 206. The heat exchanger 228 may include at least one inlet pipe 227 (e.g., hot fluid inlet) and at least one outlet pipe 229 (e.g., cold fluid outlet). A heat-exchanging fluid may be supplied to the heat exchanger through the inlet pipe 227 at a first temperature and transported away from the heat exchanger through the outlet pipe 229 at a second temperature that is less than the first temperature.

The heat exchanging fluid flowing through the heat exchanger 228 may be the same as or a different material than the fluid supplied to the control volume 206 through the pipe 210. If the first temperature of the heat-exchanging fluid entering the heat exchanger 228 is greater than a temperature of the fluid in the control volume 206, then the heat exchanger 228 may provide thermal energy to the fluid in the control volume via heat transfer. By providing thermal energy to the fluid in the control volume 206, the heat exchanger 228 may increase a temperature of the fluid in the control volume 206.

The heat exchanging fluid may be supplied to the inlet pipe 227 of the heat exchanger 228 from a variety of sources. For example, industrial heat (e.g., steam from a steam cycle nuclear power plant) may be used to provide the heat exchanging fluid to the heat exchanger 228.

In another method, a thermal collection device 223 may be on the control volume 206. Thermal input "Q in" via solar energy 222 may be collected using a thermal collection device 223. The thermal collection device 223 may transfer heat collected via solar energy 222 directly to the control volume 206 via conduction. The thermal collection device 223 may be a solar water heater, but is not limited thereto.

Finally, thermal input "Q in" just from solar energy 222 striking the control volume 206 may transfer thermal energy to the fluid in the control volume 206.

The thermal input, from either the heat exchanger 228, the thermal collection device 223, or from solar energy 222 striking the control volume 206, may be used alone and/or in combination to transfer thermal energy to the control volume 206. The thermal input from the heat exchanger 228 and/or the thermal collection device 223 may increase a temperature of the fluid in the control volume 206. Since the control volume 206 represents a static, solid, if the fluid in the control volume 206 is a non-compressible liquid, the pressure of the fluid may increase directly if the temperature of the fluid increases. As the pressure of the fluid in the control volume 206 increases, the fluid may flow via a pipe 224 at one end of the control volume 206 through a control valve 226 to the next control volume and/or a final destination. The pipe 224 may have a circumference and/or diameter that is significantly less than (e.g., less than 50% and/or less than 20% and/or less than 5%) the circumference and/or diameter of the control volume 206. The flow control valve 225 may be a one-directional valve that only allows the fluid to flow from the control volume 206 to the next control volume or a final destination in one direction. The flow control valve 225 may be an inline check valve, but is not limited thereto.

At least one pressure-relief disc 226 may be connected to the control volume 206 through a pipe portion. The pressure-relief disc 226 may be configured to relieve an internal pressure of the control volume 206 if the pressure inside the control volume 206 increases above a pressure at which the pressure-relief disc 226 may burst. The pressure-relief disc 226 may include at least one metal piece or non-metal piece in a flange, but example embodiments are not limited thereto. The metal piece or non-metal piece may be weaker than a wall of the control volume 206. As a result, when the pressure inside the control volume 206 increases, the pressure-relief disc 226 may burst at a pressure level that is less than a pressure that would cause the control volume 206 to burst.

The control volume 206 may compensate for differential heating between different control volumes. For example, if the control volume 206 receives more thermal energy than a control volume to the left (not shown), the control volume 206 may convey the fluid to the right through the pipe 224 and control valve 225 while the control volume to the left (not shown) is not supplying a fluid. In this situation, with continued heating, the fluid in the control volume 206 may produce two-phase boiling that results in a mixture of a liquid and a vapor phase. The two-phase boiling could build-up pressure inside the control volume 206 and may cause the control valve 225 to open. When the control valve 225 opens, the fluid may be conveyed through the control valve 225 to the right of the control volume 206.

Then at a different time, the thermal energy supplied to the control volume 206 may decrease and the fluid inside the control volume 206 may cool. For example, at night time or when there is cloud cover, the control volume 206 may receive less thermal energy from the thermal collection device 223. If the fluid inside the control volume 206 exists in a vapor and a liquid phase and then cools, the vapor may condense. The condensation of vapor may lower the pressure inside the control volume 206. If the pressure inside the control volume 206 decreases, then a differential pressure between the control volume 206 and a control volume to the left (not shown) may increase. A control volume to the left (not shown) may be connected to the control volume 206 through the pipe 210 and a control valve that is the same as or similar to the control valve 225 that may be used to control fluid flow between the control volume to the left (not shown) and the control volume 206. If the differential pressure between the control volume 206 and the control volume to the left (not shown) increases, the control valve regulating flow may open and fluid may flow from the control volume to the left into control volume 206. Thus, a thermal-pumping apparatus including the control volume 206 may move fluid either by heating liquid or by condensing vapor within the control volume 206.

FIGS. 3A to 3F illustrate internal conveyance systems of thermal-pumping apparatuses according to some example embodiments.

Figure 3A:
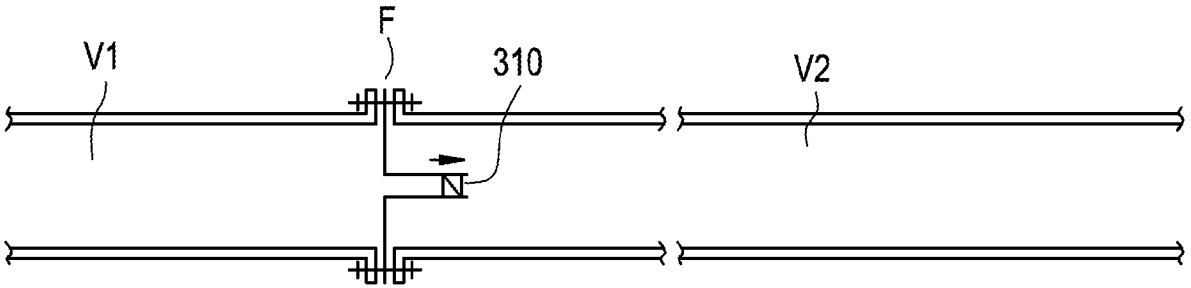
FIGS. 3A to 3F illustrate internal conveyance systems of thermal-pumping apparatuses according to some example embodiments.

Referring to FIG. 3A, in a thermal-pumping apparatus according to an example embodiment, a first control volume V1 may be serially-connected to a second control volume V2 with a connection structure. The first and second control volumes V1 and V2 may be pipes, but are not limited thereto. The connection structure may include a flange F and at least one control valve 310 mounted on the flange F with no leaking surface between the first control volume V1 and the second control volume V2. The control valve 310 may be surrounded by the second control volume V2. The control valve 310 may be a one-directional valve that allows fluid to flow in one direction only from the first control volume V1 to the second control volume V2 if the pressure of fluid in the first control volume V1 is greater than the pressure of fluid in the second control volume V2, and the differential pressure of fluid in the first and second control volumes V1 and V2 is greater than or equal to a threshold (e.g., set point) of the control valve 310. The control valve 310 may be a check valve, but is not limited thereto.

Conversely, flow of the fluid 10 from the first control volume V1 to the second control volume V2 may stop if the control valve 310 closes. The control valve 310 may close if the pressure of the fluid 10 in the first control volume V1 is less than the pressure of the fluid 10 in the second control volume V2 and/or if the differential pressure between the first and second control volumes V1 and V2 is less than a threshold of the control valve 310.

When fluid is supplied the first control volume V1, thermal energy may be provided to the first control volume V1 in order to increase a pressure of the fluid in the first control volume V1. As the pressure in the first control volume V1 increases, the control valve 310 may open if the pressure of fluid in the first control volume V1 is greater than the pressure of fluid in the second control volume V2, and the differential pressure of fluid in the first and second control volumes V1 and V2 is greater than or equal to a threshold (e.g., set point) of the control valve 310.

Figure 3B:
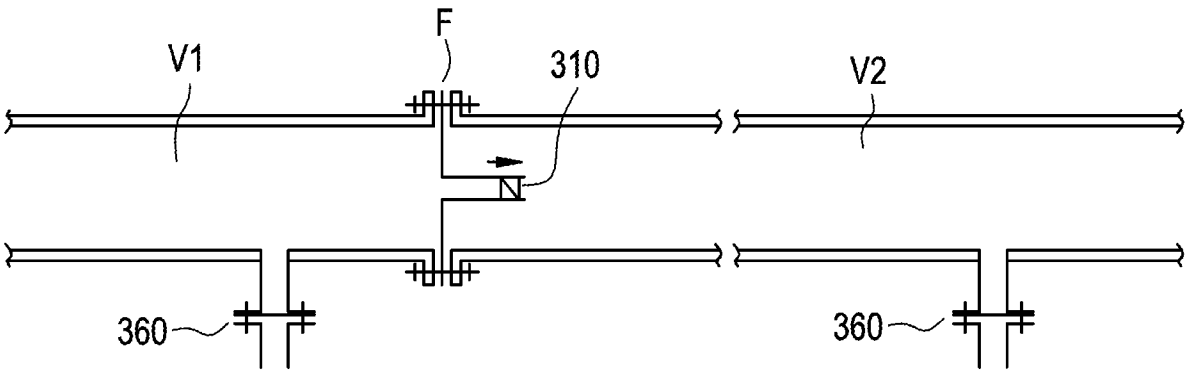

Referring to FIG. 3B, in a thermal-pumping apparatus according to an example embodiment, the first control volume V1 and the second control volume V2 may be serially connected with a flange F in the same arrangement as described previously with reference to FIG. 3A. However, at least one of the first and second control volumes V1 and V2 may further include a pressure-relief disc 360 mounted on a surface of the control volumes V1 and/or V2 through a respective pipe portion.

The pressure-relief disc 360 attached to a bottom surface of the first control volume V1 may be configured to relieve an internal pressure of the first control volume V1 if the pressure inside the first control volume V1 increases above a pressure at which the pressure-relief disc 360 may burst. The pressure-relief disc 360 may include at least one metal piece or non-metal piece in a flange, but example embodiments are not limited thereto. The metal piece or non-metal piece may be weaker than a wall of the first control volume V1. As a result, when the pressure inside the first control volume V1 increases, the pressure-relief disc 360 may burst at a pressure level that is less than a pressure that would cause the first control volume V1 to burst. The pressure-relief disc 360 attached to a bottom surface of the second control volume V2 similarly may be configured to relieve an internal pressure of the second control volume V2 if the pressure inside the second control volume V2 increases above a pressure at which the pressure-relief disc 360 may burst.

Although FIG. 3B illustrates a non-limiting example where the first control volume V1 includes a pressure-relief disc 360 attached to a bottom surface and the second control volume V2 includes a pressure-relief disc 360 attached to a bottom surface, example embodiments are not limited thereto. The positions where the pressure-relief discs 360 may be attached to the control volumes V1 and V2 may vary. More than one pressure-relief disc 360 may be attached to the first control volume V1 and/or the second control volume V2. The number of pressure-relief discs 360 attached to the first control volume V1 may be the same as or different than the number of pressure relief discs 360 attached to the second control volume V2. The pressure-relief discs 360 attached to the first control volume V1 may be attached at positions that are the same as or different than the positions where pressure-relief discs 360 may be attached to the second control volume V2. Additionally, one of the first and second control volumes V1 and V2 may have no pressure-relief discs 360 attached at all while the other of the first and second control volumes V1 and V2 has pressure-relief discs 360 attached.

Figure 3C:
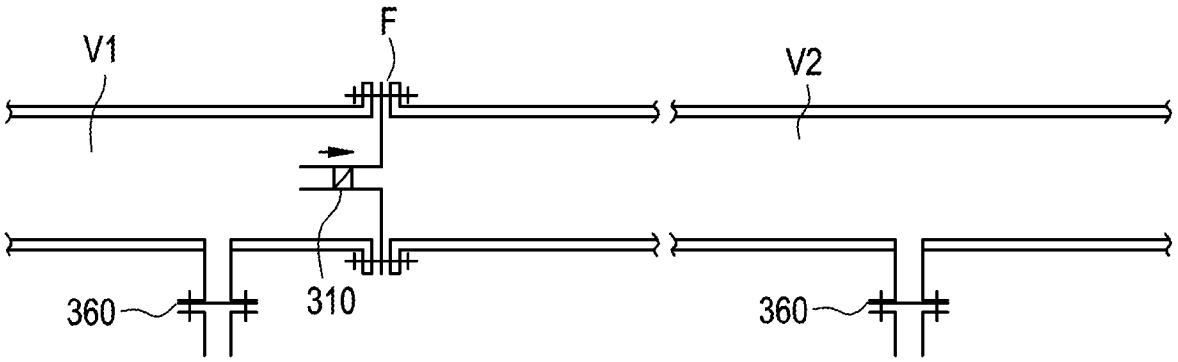

Referring to FIG. 3C, in a thermal-pumping apparatus according to an example embodiment, the first control volume V1 and the second control volume V2 may be serially connected with a flange F in the same arrangement as described previously with reference to FIG. 3B. However, the control valve 310 may alternatively be surrounded by the first control volume V1. When the control valve 310 is open, the control valve may allow fluid to flow only from the first control volume V1 to the second control volume V2. When the control valve 310 is closed, the control valve may limit and/or prevent fluid flow between the first and second control volumes V1 and V2.

Figure 3D:
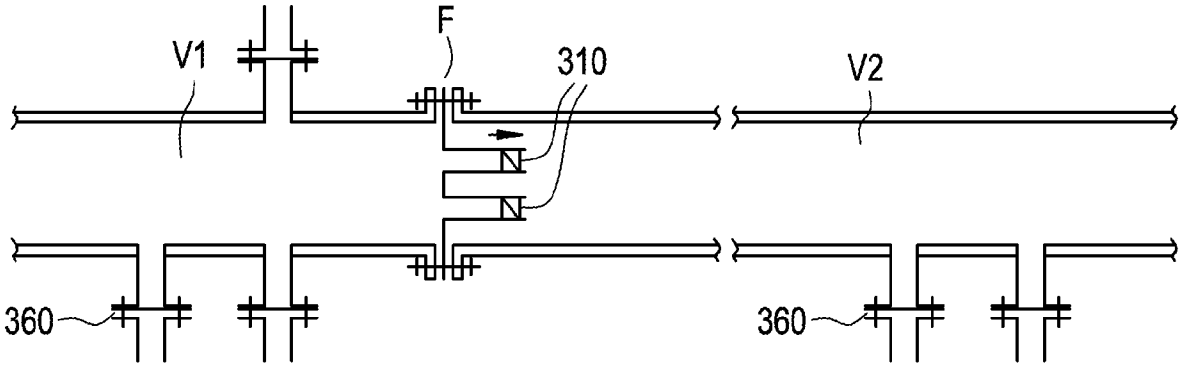

Referring to FIG. 3D, in a thermal-pumping apparatus according to an example embodiment, the first control volume V1 and the second control volume V2 may be serially connected with a flange F in the same arrangement as described previously with reference to FIG. 3B. However, a plurality of control valves 310 may be mounted on the flange F connecting the first control volume V1 to the second control volume V2. Additionally, instead of just one pressure-relief disc 360 attached at a bottom surface of the first control volume V1, the first control volume V1 may include a plurality of pressure-relief discs 360 attached at a bottom surface and at least one pressure-relief disc 360 on a top surface. The second control volume V2 may also include a plurality of pressure-relief discs 360 attached at a bottom surface and at least one pressure-relief disc 360 on a top surface.

Figure 3E:
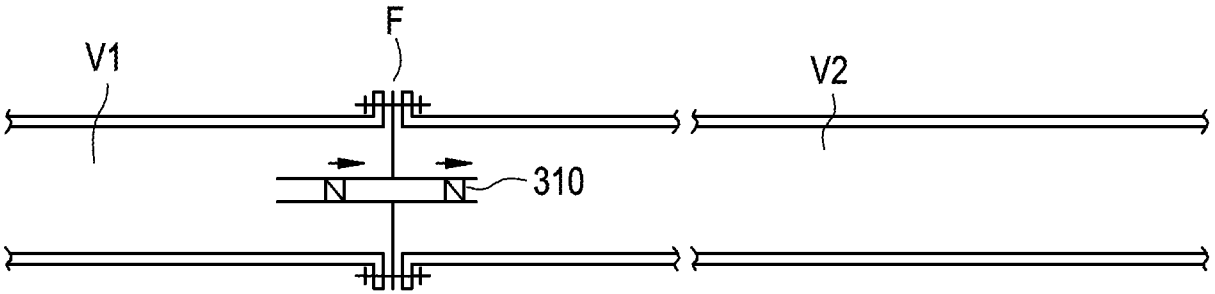

Referring to FIG. 3E, in a thermal-pumping apparatus according to an example embodiment, the first control volume V1 and the second control volume V2 may be serially connected with a flange F in the same arrangement as described previously with reference to FIG. 3A. However, the flange F may further include a plurality of control valves 310 mounted to the flange F. The flange F may include at least one control valve 310 that is surrounded by the second control volume V2 and at least one control valve 310 that is surrounded by the first control volume V1.

Figure 3F:
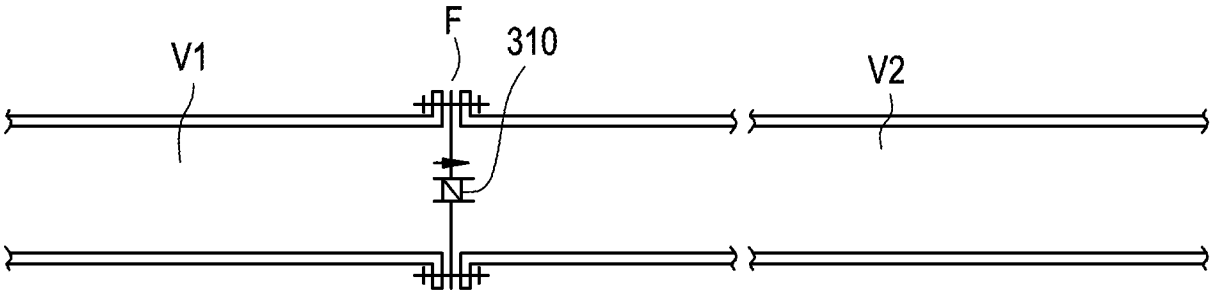

Referring to FIG. 3F, in a thermal-pumping apparatus according to an example embodiment, the first control volume V1 and the second control volume V2 may be serially connected with a flange F in the same arrangement as described previously with reference to FIG. 3A. However, the control valve 310 may alternatively be disposed at an interface between the first control volume V1 and the second control volume V2. Although FIG. 3F illustrate one control valve 310 disposed at an interface between the first and second control volumes V1 and V2, example embodiments are not limited thereto and a plurality of control valves 310 may be at an interface between the first and second control volumes V1 and V2.

Figure 4:
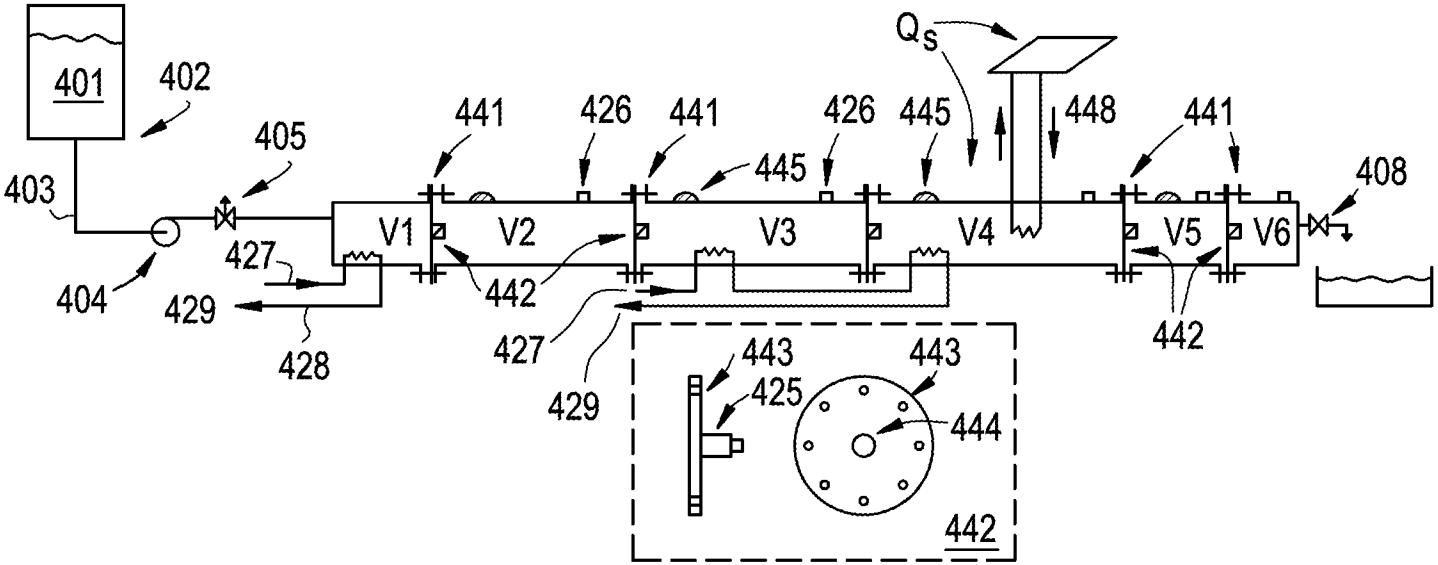
FIG. 4 is an illustration of a thermal-pumping apparatus according to an example embodiment.

FIG. 4 is an illustration of a thermal-pumping apparatus according to an example embodiment.

A thermal-pumping apparatus according to an example embodiment may include six control volumes V1 to V6 serially connected to each other. Those of ordinary skill in art would see, however, that the number of control volumes connected to each other may be more than six or fewer than six control volumes V1 to V6.

A fluid 401 may be collected from a source such as a tank 402 and may be transported through a pipe 403 to the inlet of a pump 404. The fluid 401 may be water, but is not limited thereto. Also, the source is not limited to being a tank. The pump 404 may pump the fluid 401 through the control valve 405 into the first control volume V1.

The pump 404 may be an electrically-powered or a mechanically-powered pump. The second to sixth control volumes V2 to V6 may be serially connected to each other without direct connections to at least one of an electrically-powered pump and a mechanically-powered pump. In this situation, at least one of an electrically-powered pump and a mechanically-powered pump may not be directly connected to one of the second to sixth control volumes V2 to V6 and/or configured to increase a pressure of fluid 401 in the second to sixth control volumes V2 to V6.

Alternatively, in some example embodiments, a pump may be provided between a first plurality of control volumes serially-connected to each other and a second plurality of control volumes serially-connected to each other. However, at least some of the first plurality of control volumes and at least some of the second plurality of control volumes may not be directly connected to an electrically-powered or a mechanically-powered pump.

Although FIG. 4 illustrates one tank 402, one pipe 403, one pump 404, and one control valve 405 connected to the first control volume V1, example embodiments are not limited thereto. The number of tanks 402, pipes 403, pumps 404, and control valves 405 used to supply the fluid 401 to the first control volume V1 may be greater than one each.

Each one of the control volumes V1 to V6 may be connected to an adjacent one of the control volumes V1 to V6 with a connection structure. The connection structure may include flanges 441 and a separation plate 442. The flanges 441 may be bolted pipe flanges. Each separation plate 442 may be positioned between adjacent ones of the control volumes V1 to V6. The separation plate 442 may include a plate 443 between two flanges 441 that are bolted through the holes defined in the plate 443. In the center of the plate 443, a threaded hole 444 may allow the installation of a relief check valve 425. The relief check valve 425 may be a one-directional valve. However, one of ordinary skill in the art would appreciate that the threaded hole 444 may be in a position other than the center of the plate 443. Also, the plate 443 may include more than one threaded hole 444 to allow the installation of more than one relief check valve 425.

A heat exchanger 428 may transfer thermal energy to the fluid 401 in the first control volume V1. The heat exchanger 428 may be positioned at least partially in the first control volume V1 and/or include coils that wrap around the first control volume V1. The heat exchanger 428 may include at least one inlet pipe 427 (e.g., hot fluid inlet) and at least one outlet pipe 429 (e.g., cold fluid outlet). A heat-exchanging fluid may be supplied to the heat exchanger through the inlet pipe 427 at a first temperature and transported away from the heat exchanger 428 through the outlet pipe 429 at a second temperature that is less than the first temperature.

Other control volumes V2 to V6 may also have a heat exchanger positioned to transfer thermal energy to the fluid 401 in the other control volumes V2 to V6. For example, one heat exchanger may include at least one inlet pipe 427 and at least one outlet pipe 429 to transfer thermal energy to the third and fourth control volumes V3 and V4.

The heat exchanging fluid flowing through the heat exchanger 428 may be the same as or a different material than the fluid 401 supplied to the first control volume V1. Industrial heat (e.g., steam from a steam cycle nuclear power plant) may be used to provide the heat exchanging fluid to the heat exchanger 428.

At least one pressure-relief disc 426 may be independently attached to one or more of the control volumes V1 to V6. Each pressure-relief disc 426 may be attached a corresponding one of the control volumes V1 to V6 through a respective pipe portion. Although not illustrated, at least one pressure-relief disc 426 may also be attached to the first control volume V1. Each pressure-relief disc 426 may be configured to relieve an internal pressure of a corresponding one of the control volumes V1 to V6 that the pressure-relief disc 426 contacts if the pressure inside the corresponding one of control volumes V1 to V6 increases above a pressure at which the pressure-relief disc 426 may burst. The pressure-relief disc 426 may include at least one metal piece or non-metal piece in a flange, but example embodiments are not limited thereto. The metal piece or non-metal piece may be weaker than a wall of the corresponding one of the control volumes V1 to V6. As a result, when the pressure inside the corresponding one of the control volumes V1 to V6 increases, the pressure-relief disc 426 may burst at a pressure level that is less than a pressure that would cause the corresponding one of the control volumes V1 to V6 to burst.

A thermal collection device 448 may be on at least one of the control volumes V1 to V6 for collecting thermal input "Qs" via a heat source such as solar energy. The thermal collection device 448 may transfer heat collected directly via conduction to a corresponding one of the control volumes V1 to V6 that contacts the thermal collection device 448.

The thermal collection device 448 may be a solar water heater, but example embodiments are not limited thereto.

As the fluid 401 is supplied to the first control volume V1, thermal energy may increase a pressure of the 401 fluid in the first control volume V1. The fluid 401 may fill the first control volume V1 until the pressure inside the first control volume V1 reaches a sufficient pressure to open the relief check valve 425. For example, the relief check valve 425 may be configured to open so the fluid 401 flows from the first control volume V1 to the second control volume V2 if the pressure of fluid 401 in the first control volume V1 is greater than the pressure of fluid in the second control volume V2, and if the differential pressure of fluid 401 in the first and second control volumes V1 and V2 is greater than or equal to a threshold (e.g., set point) of the relief check valve 425.

When the fluid 401 flows from the first control volume V1 to the second control volume V2, the pressure and fluid amount in the first control volume V1 may decrease if the first control volume V1 does not receive additional fluid 401. However, the control valve 405 can be configured to open when the pressure and volume of the fluid 401 in the first control volume V1 falls below a threshold (e.g., set point), so the pump 404 can reestablish the fluid 401 volume and pressure in the first control volume V1. By this operation, the control valve 405 working with the pump 404 can automatically provide fluid 401 to the first control volume V1 and ensure that the first control volume V1 remains full with fluid 401.

Flow of the fluid 401 from the first control volume V1 to the second control volume V2 may continue as long as the first control volume V1 has an adequate fluid supply and as long as relief check valve 425 is open. The relief check valve 425 may remain open if the differential pressure of the fluid 401 in the first and second control volumes V1 and V2 is greater than the threshold of the relief check valve 425. Conversely, flow of the fluid 401 from the first control volume V1 to the second control volume V2 may stop if the relief check valve 425 is closed. The relief check valve 425 may close if the pressure of the fluid 401 in the first control volume V1 is less than the pressure of the fluid 401 in the second control volume V2 and/or if the differential pressure between the first and second control volumes V1 and V2 is less than a threshold of the relief check valve 425.

When the fluid flows from the first control volume V1 to the second control volume V2, the newly introduced fluid 401 in the second control volume V2 may come into thermal equilibrium with other fluid in the second control volume V2. Thermal energy may be added to the fluid 401 in the second control volume V2. As thermal energy is added to the fluid 401 in the second control volume V2, the temperature of the fluid 401 in the second control volume V2 may increase. When the temperature of the fluid 401 in the second control volume V2 increases, the pressure of the fluid 401 in the second control volume V2 may also increase.

The fluid 401 may fill the second control volume V2 until the pressure inside the second control volume V2 reaches a sufficient pressure to open the relief check valve 425 in the separation plate 442 between the second control volume V2 and the third control volume V3. For example, the relief check valve 425 may be configured to open so the fluid 401 flows from the second control volume V2 to the third control volume V3 if the pressure of fluid 401 in the second control volume V2 is greater than the pressure of fluid in the third control volume V3, and if the differential pressure of fluid 401 in the second and third control volumes V2 and V3 is greater than or equal to a threshold (e.g., set point) of the relief check valve 425.

This process of thermal-pumping may continue until the fluid 401 is transported from the first control volume V1 through the sixth control volume V6. When the fluid 401 flows into the sixth control volume V6, an end user may collect the fluid by opening a valve 408 at the outlet opening of the sixth control volume V3.

A distributed control and information system (DCIS) may include sensors 445 located on the control volumes V1 to V6, respectively. Although FIG. 4 illustrates a case where the sensors 445 are on the second to fifth control volumes V2 to V6, respectively, a corresponding one of the sensors 445 may also be on the first control volume V1 and/or the sixth control volume V6, respectively. Additionally, some of the second to fifth control volumes V2 to V6 may have corresponding sensors 445. Through the sensors 445, the DCIS may provide information to operators of the thermal-pumping apparatus on the status of pumping and flow rates of fluid through the six control volumes V1 to V6. For example, each sensor 445 may be configured to measure the temperature, flow rate, and pressure in a corresponding one of the volume volumes V1 to V6. The DCIS may be configured to provide information gathered from the sensors 445 to operators of the thermal-pumping apparatus.

In summary, a thermal-pumping apparatus according to an example embodiment may utilize three operating steps. First, a pump 404 may fill the first control volume V1 with fluid 401. Second, the fluid 401 may be conveyed from the first control volume V1 to the sixth control volume V6 using thermal energy. Finally, at the sixth control volume V6, an end user may collect the fluid 401 by opening a valve 408.

Figure 5:
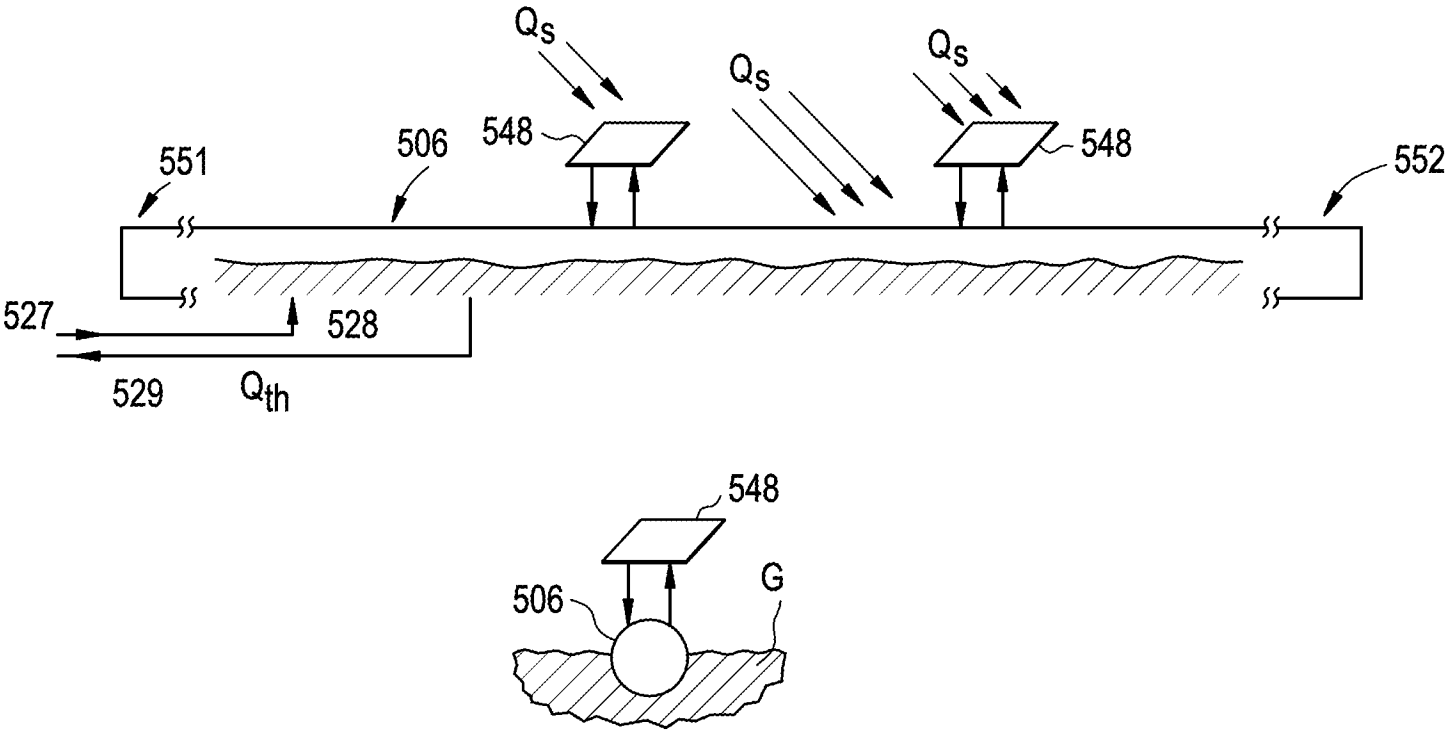
FIG. 5 is an illustration of thermal-pumping apparatus according to an example embodiment.

FIG. 5 is an illustration of a thermal pumping apparatus according to an example embodiment.

Regarding to FIG. 5, a thermal pumping apparatus according an example embodiment may take advantage of the physically supportive and insulating properties of the ground in at least some sections. The thermal pumping apparatus may include a plurality of control volumes 506 (e.g., pipes) serially connected to each other in a way that is the same as or similar to the thermal-pumping apparatus described previously in FIG. 4. The filling end 551 and the discharge end 552 may not be in the ground and may be fully accessible.

Between the filling and discharge ends 551 and 552, which can stretch for miles, the thermal pumping apparatus may be partially buried into the ground. The above-grade portions of the pumping apparatus may be covered with insulation to reduce heat loss. The below-grade portions of the thermal pumping apparatus may be insulated to further reduce heat-loss.

Heat may be added to thermal pumping apparatus by three methods: industrial heat (e.g., steam from a power plant), radiant energy from a heat source Qs (e.g., solar energy) that is absorbed by a thermal collection device 548 and transferred to the thermal collection apparatus, and by radiant energy from a heat source Qs (e.g., solar energy) striking directly on the control volumes 506. The industrial heat may be transferred to at least one control volume 506 through a heat exchanger 528. The heat exchanger 528 may include at least one inlet pipe 527 (e.g., hot fluid inlet) and at least one outlet pipe 529 (e.g., cold fluid outlet). A heat-exchanging fluid may be supplied to the heat exchanger through the inlet pipe 527 at a first temperature and transported away from the heat exchanger through the outlet pipe 529 at a second temperature that is less than the first temperature.

Figure 6:
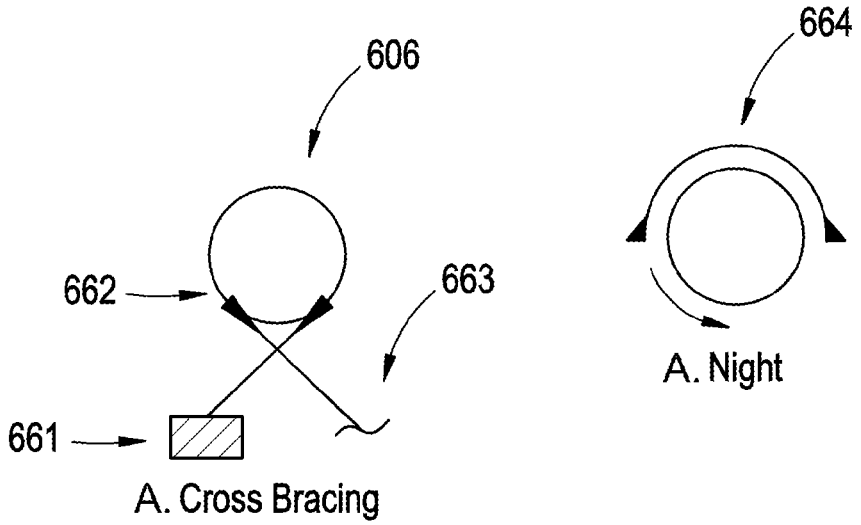
FIG. 6 is an illustration of a thermal-pumping apparatus according to an example embodiment.
Figure 6:
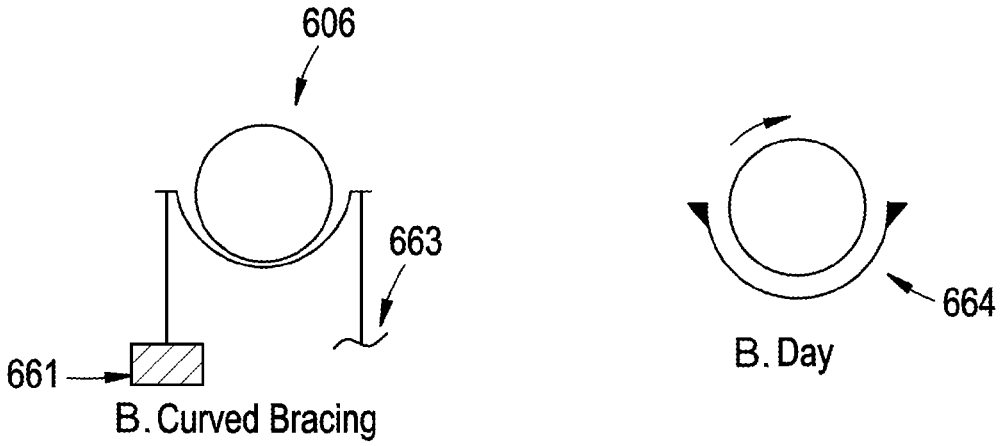

FIG. 6 is an illustration of a thermal pumping apparatus according to an example embodiment.

Referring to FIG. 6, in a thermal pumping system according to an example embodiment, some sections may be spaced apart from the ground. Struts 662 may be used to support at least one control volume 606 above the ground 663. The struts 662 may be arranged in a cross-bracing formation or a curved bracing formation to support at least one control volume 606, but example embodiments are not limited thereto. The struts 662 may be supported by a firm surface 661 (e.g., concrete foundation) on the ground 663.

Thermal losses may decrease the thermal pumping efficiency of the thermal-pumping apparatus. Accordingly, during the day, when solar energy is available to transfer thermal energy to the control volume 606, an insulation cover 664 may be wrapped around a bottom surface of the control volume 606. The insulation cover 664 may limit and/or prevent heat loss through the bottom of the control volume 606. At night, the insulation cover 664 may be wrapped over the top of the control volume 606 to mitigate thermal energy loss.

Figure 7:
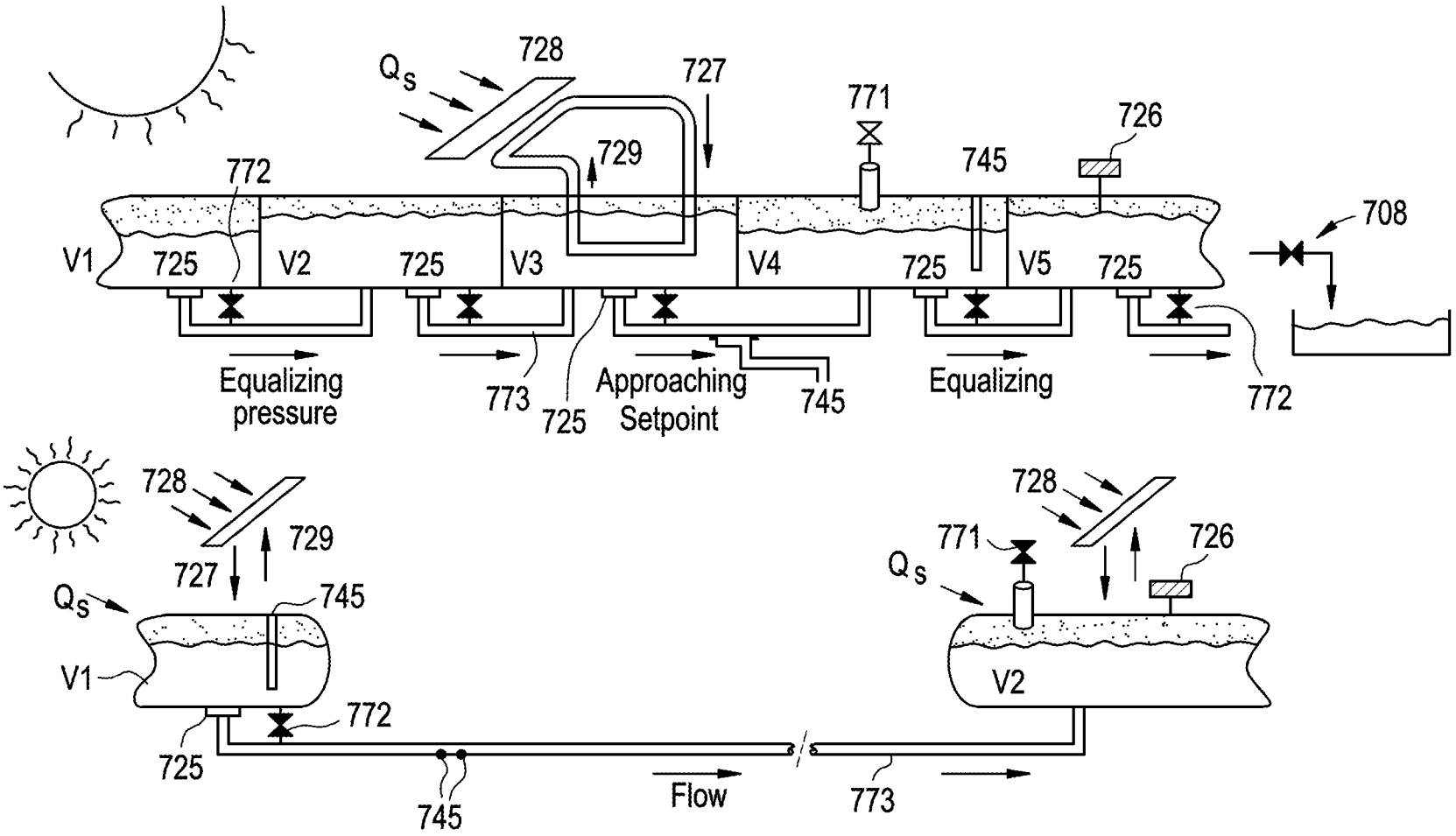
FIG. 7 is an illustration of a thermal-pumping apparatus according to an example embodiment.

FIG. 7 is an illustration of a thermal-pumping apparatus according to an example embodiment.

According to an example embodiment, a thermal-pumping apparatus may boil fluid to pressurize control volumes, and transfer a liquid portion of the fluid through the lower portions of the control volumes to maintain the vapor/airspace in each control volume.

Referring to FIG. 7, a thermal-pumping apparatus may include five control volumes V1 to V5 serially connected to each other to convey a fluid to a point of use. An end user at the point of use may open a valve 708 to collect the fluid. The fluid conveyed through the control volumes V1 to V5 may be water, but is not limited thereto. Those of ordinary skill in art would see, however, how the number of control volumes connected to each other may be more than five or fewer than five control volumes V1 to V5.

Unlike the thermal pumping apparatus described previously with reference to FIG. 4, the thermal pumping apparatus shown in FIG. 7 may convey fluid between adjacent control volumes through exterior connection structures. The exterior connection structures may include equalizing lines 773 outside of the control volumes V1 to V5, control valves 725, and bypass valves 772. Each one of the control volumes V1 to V5 may include one of the control valves 725 at a bottom surface. The control valves 725 may be attached to outlet openings defined by the control volumes V1 to V5. The control valves 725 may be check valves. The control valves 725 may be one-directional valves. Each equalizing line 773 may be connected to an outlet of a corresponding one of the control valves 725 and an inlet opening defined by a corresponding one of the control volumes V1 to V5. One of the bypass valves 772 may be connected between each equalizing line 773 and a corresponding one of the control volumes V1 to V5. The bypass valves 772 may be connected to bypass openings defined by the control volumes V1 to V5. The bypass valve 772, if open, may be configured to selectively allow fluid to flow into the equalizing line 773 without using the control valve 725.

The control volumes V1 to V5 may each receive thermal energy from a heat source Qs. For example, the solar collection device 728 on the third control volume V3 may use solar energy to circulate a heat-transfer fluid. Reference character 727 shows where the heat exchanging fluid at a first temperature ("hot fluid") may circulate into the third control volume V3 and reference character shows where the heat exchanging fluid at a second temperature ("cold fluid") exits the third control volume V3. The second temperature may be lower than the first temperature. However, solar energy may be used to heat the heat exchanging fluid back to a higher temperature before recirculating the heat exchanger fluid through the third control volume V3. Instead of circulating through the third control volume V3, the solar collection device 728 may include coils that wrap around the third control volume V3. Each one of the control volumes V1 to V5 may also have a solar collection device 728 arranged to transfer thermal energy to the fluid in a corresponding one of the control volumes V1 to V5.

Additionally, although not shown, one or more of the control volumes V1 to V5 may be connected to a heat exchanger that is the same as or similar to the heat exchanger 228 discussed previously with reference to FIG. 2 for transferring thermal energy to one or of the control volumes. Finally, thermal energy may be transferred to the control volumes V1 to V5 from solar energy striking the control volumes V1 to V5.

As the control volumes V1 to V5 receive thermal energy from a heat source Qs, the fluid in the control volumes V1 to V5 may vaporize after enough heat energy is absorbed. A portion of the fluid may become a vapor in the airspace at the top of the control volume V1 to V5.

As vaporization continues, the pressure in the control volumes V1 to V5 may increase until the setpoints of the control valves 725 are reached. The control valves 725 may be designed to open based on a differential pressure between each one of the control volumes V1 to V5 and an adjacent one of the control volumes V1 to V5. For example, in the first control volume V1, if the pressure of the fluid in the first control volume V1 is greater than the pressure of the fluid in the second control volume V2, and the differential pressure between the first and second control volumes V1 and V2 is greater than the threshold of the control valve 725, then the control valve 725 attached to the first volume structure V1 will open. Since the vapor portion of the fluid in the first control volume V1 will stay on top due its lower density, only the liquid portion of the fluid in the first control volume V1 will exit through the control valve 725. Once forced into the equalizing lines 773 the liquid portion of the fluid then travels to the second control volume V2. The process begins again in the second control volume V2 and the fluid may be thermally-pumped successively to the fifth control volume V5.

In order to obtain the proper amount of airspace during the initial fill, shutdown, or maintenance of the system, each one of the control volumes V1 to V5 may be equipped with a DCIS controlled air exhaust valve 771. The exhaust valves 771 may be connected to exhaust openings defined by the control volumes V1 to V5. The exhaust valve 771 may allow air to escape from a selected one of the control volumes V1 to V5 as a liquid phase of the fluid enters the selected one of the control volumes V1 to V5. The exhaust valve 771 may provide a path for air or a gas phase of the fluid to escape the selected one of the control volumes as it is being filled (e.g., during an initial fill and/or to maintain a desired fluid level during operation). The exhaust valve 771 may provide a path for air or a gas phase of the fluid to enter the selected one of the control volumes in the event the fluid levels needs to be lowered for operation and/or for maintenance.

The DCIS system may include sensors 745 in the control volumes V1 to V5 to measure a pressure, temperature, and/or fluid level in each one of the control volumes V1 to V5 respectively. The DCIS system may also include sensors 745 in the equalizing lines 773, respectively to measure the flow rate of the fluid through respective equalizing lines 773 between adjacent control volumes of the control volumes V1 to V5. Based on the pressure, temperature, fluid level, and flow rate data collected by the DCIS system, the DCIS system may open or close a selected one of the air exhaust valves 771 in order to relieve an internal pressure of one of the control volumes V1 to V5 corresponding to the selected air exhaust valve 771. Alternatively, the DCIS system may report data to an operator, and an operator may determine whether to open or close a selected one of the air exhaust valves 771.

The bypass valves 772 allow taking the control valves 725 out of service during maintenance operations and/or when one of the control valves 725 is replaced. Additionally, if one of the control valves 725 becomes non-operational, the corresponding bypass valve 772 connected to the same equalizing line 773 could be opened to continue the service of the system. The bypass valves 772 may be manually operated or operated with a DC or AC power source through DCIS. The bypass valves 772 may be one-directional valves.

At least one pressure-relief disc 726 may be independently attached to one or more of the control volumes V1 to V5. Each pressure-relief disc 726 may be connected to a corresponding one of the control volumes V1 to V5 through a respective pipe portion. Each pressure-relief disc 726 may be configured to relieve an internal pressure of a corresponding one of the control volumes V1 to V5 that the pressure-relief disc 726 contacts if the pressure inside the corresponding one of control volumes V1 to V5 increases above a pressure at which the pressure-relief disc 726 may burst. The pressure-relief disc 726 may include at least one metal piece or non-metal piece in a flange, but example embodiments are not limited thereto. The metal piece or non-metal piece may be weaker than a wall of the corresponding one of the control volumes V1 to V5. As a result, when the pressure inside the corresponding one of the control volumes V1 to V5 increases, the pressure-relief disc 726 may burst at a pressure level that is less than a pressure that would cause the corresponding one of the control volumes V1 to V5 to burst.

Figure 8A:
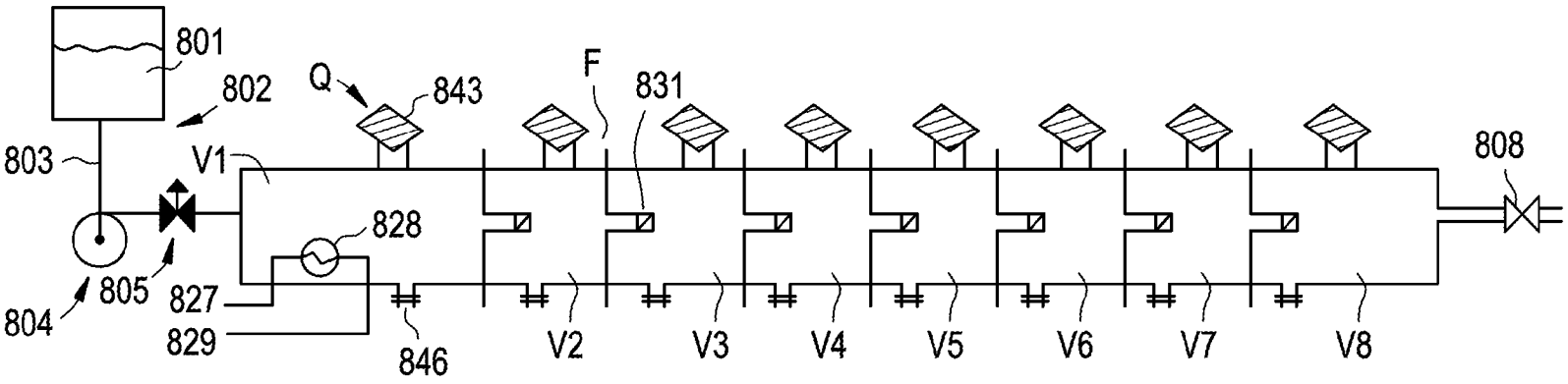
FIGS. 8A to 8C illustrate thermal-pumping apparatuses according to some example embodiments.
Figure 8B:
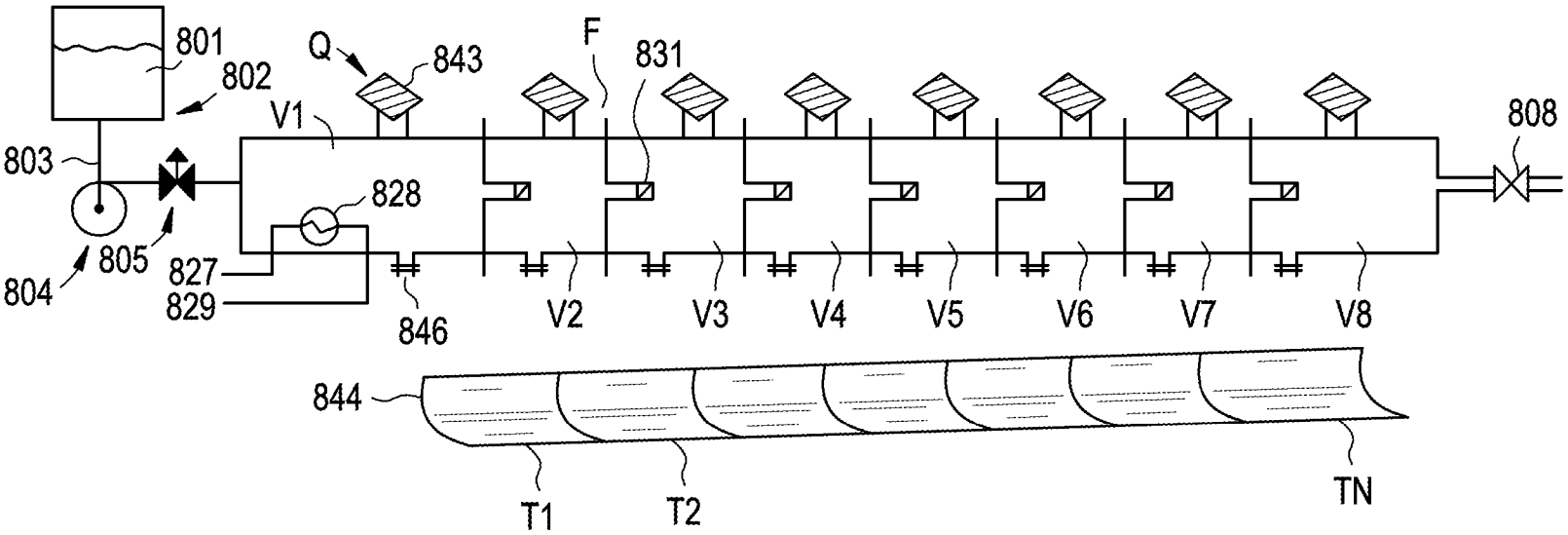
Figure 8C:
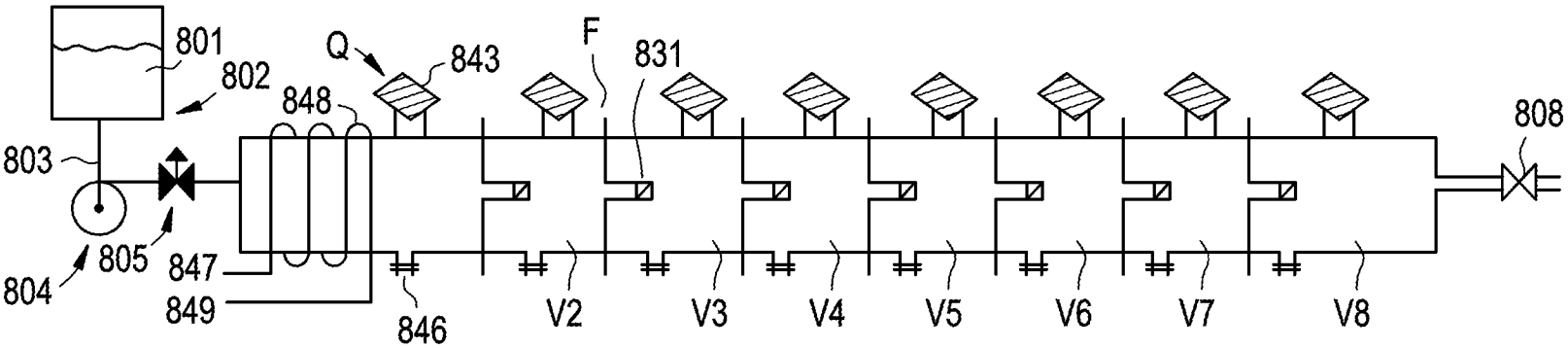

FIGS. 8A to 8C illustrate thermal-pumping apparatuses according to some example embodiments.

Referring to FIG. 8A, a thermal-pumping apparatus according to an example embodiment may include eight control volumes V1 to V8 serially-connected to each other. While eight control volumes V1 to V8 are illustrated, the number of serially-connected control volumes may be fewer than eight or more than eight.

A fluid 801 may be collected from a source such as a tank 802 and may be transported through a pipe 803 to the inlet of a pump 804. The fluid 801 may be water, but is not limited thereto. Also, the source is not limited to being a tank. The pump 804 may pump the fluid 801 through the control valve 805 into the first control volume V1.

The pump 804 may be an electrically-powered or a mechanically-powered pump. The second to eighth control volumes V2 to V8 may be serially connected to each other without direct connections to at least one of an electrically-powered pump and a mechanically-powered pump. In this situation, at least one of an electrically-powered pump and a mechanically-powered pump may not be configured to increase a pressure of fluid 801 in the second to eight control volumes V2 to V8.

Alternatively, in some example embodiments, a pump may be provided between a first plurality of control volumes serially-connected to each other and a second plurality of control volumes serially-connected to each other. However, at least some of the first plurality of control volumes and at least some of the second plurality of control volumes may not be directly connected to an electrically-powered or a mechanically-powered pump.

Although FIG. 8A illustrates one tank 802, one pipe 403, one pump 804, and one control valve 805 connected to the first control volume V1, example embodiments are not limited thereto. The number of tanks 802, pipes 403, pumps 804, and control valves 805 used to supply the fluid 401 to the first control volume V1 may be greater than one each.

Each one of the control volumes V1 to V8 may be connected to an adjacent one of the control volumes V1 to V8 with a connection structure. The connection structure may include flanges F and a control valve 831 connected to each flange F. Each control valve 831 may be surrounded by a corresponding one of the control volumes V1 to V8. The control valves 831 may be one-directional valves. For example, the control valve 831 surrounded by third control volume V3 may only allow fluid to flow from the second control volume V2 to the third control volume V3. The control valves 831 may be check valves.

A heat exchanger 828 may transfer thermal energy to the fluid 801 in the first control volume V1. The heat exchanger 828 may be positioned at least partially in the first control volume V1 and/or include coils that wrap around the first control volume V1. The heat exchanger 828 may include at least one inlet pipe 827 (e.g., hot fluid inlet) and at least one outlet pipe 829 (e.g., cold fluid outlet). A heat-exchanging fluid may be supplied to the heat exchanger through the inlet pipe 827 at a first temperature and transported away from the heat exchanger 828 through the outlet pipe 829 at a second temperature that is less than the first temperature. Industrial heat (e.g., steam from a steam cycle nuclear power plant) may be used to provide the heat exchanging fluid to the heat exchanger 828.

Other control volumes V2 to V8 may also have a heat exchanger positioned to transfer thermal energy to the fluid 801 in the other control volumes V2 to V8.

At least one pressure-relief disc 846 may be independently attached to one or more of the control volumes V1 to V8. Each pressure-relief disc 846 may be connected to a corresponding one of the control volumes V1 to V8 through a respective pipe portion. Each pressure-relief disc 846 may be configured to relieve an internal pressure of a corresponding one of the control volumes V1 to V8 that the pressure-relief disc 846 contacts if the pressure inside the corresponding one of control volumes V1 to V8 increases above a pressure at which the pressure-relief disc 846 may burst. The pressure-relief disc 846 may include at least one metal piece or non-metal piece in a flange, but example embodiments are not limited thereto. The metal piece or non-metal piece may be weaker than a wall of the corresponding one of the control volumes V1 to V8. As a result, when the pressure inside the corresponding one of the control volumes V1 to V8 increases, the pressure-relief disc 846 may burst at a pressure level that is less than a pressure that would cause the corresponding one of the control volumes V1 to V8 to burst.

A thermal collection device 843 may be on at least one of the control volumes V1 to V8 for collecting thermal input Q via a heat source such as solar energy. The thermal collection device 843 may transfer heat collected directly via conduction to a corresponding one of the control volumes V1 to V8 that contacts the thermal collection device 843. The thermal collection device 843 may be a solar water heater, but example embodiments are not limited thereto.

In addition to thermal energy received by the thermal collection device 843 and/or the heat exchanger 828, the control volumes V1 to V8 may receive thermal energy from the solar energy striking the control volumes V1 to V8.

As fluid 801 is supplied to the first control volume V1, the fluid 801 may be thermally-pumped successively from the first control volume V1 to the eighth control volume V8. An end user may open a valve 808 to collect the fluid 801.

According to an example embodiment, the thermal pumping apparatus illustrated in FIG. 8A may be manufactured by connecting the first control volume V1 to the second control volume V2 with a connection structure. The connection structure may join the outlet opening of the first control volume V1 to the inlet opening of the second control volume V2. The connection structure may include a control valve 831 and the flange F. A plurality of control volumes, such as the first control volume V1 to the eight control volume V2, may be serially-connected to each other using connection structures. Each one of the connection structures may include the control valve 831 and the flange F.

The method may further include connecting at least one of the pressure-relief disc 846, the heat exchanger 828, and the thermal collection device 843 to at least one of the first and second volume structures V1 and V2. Each pressure-relief disc 846 may be connected to a corresponding one of the first and second volume structures V1 and V2 through a respective pipe portion.

Referring to FIG. 8B, a thermal-pumping apparatus according to an example embodiment may be the same as the thermal-pumping apparatus described above with reference to FIG. 8A. However, the thermal pumping apparatus illustrated in FIG. 8B may further include a solar reflector 844 positioned to reflect solar energy towards some or all of the control volumes V1 to V8.

Referring to FIG. 8C, a thermal-pumping apparatus according to an example embodiment may be the same as the thermal-pumping apparatus described above with reference to FIG. 8A, except for the structure of the heat exchanger. The thermal pumping apparatus illustrated in FIG. 8C includes a heat exchanger 848 with coils wrapping around the first control volume V1. A heat exchanging fluid at a first temperature may enter the coils where reference character 847 is shown. The heat exchanging fluid at a second temperature may exit the coils where reference character 849 is shown. The second temperature may be less than the first temperature. Industrial heat (e.g., steam from a steam cycle nuclear power plant) may be used to provide the heat exchanging fluid to the heat exchanger 848. Although FIG. 8C illustrates the heat exchanger 848 arranged to transfer thermal energy to the first control volume V1, one or more of the other control volumes V2 to V8 may also have a heat exchanger 848 arranged to transfer thermal energy to them.

Figure 9:
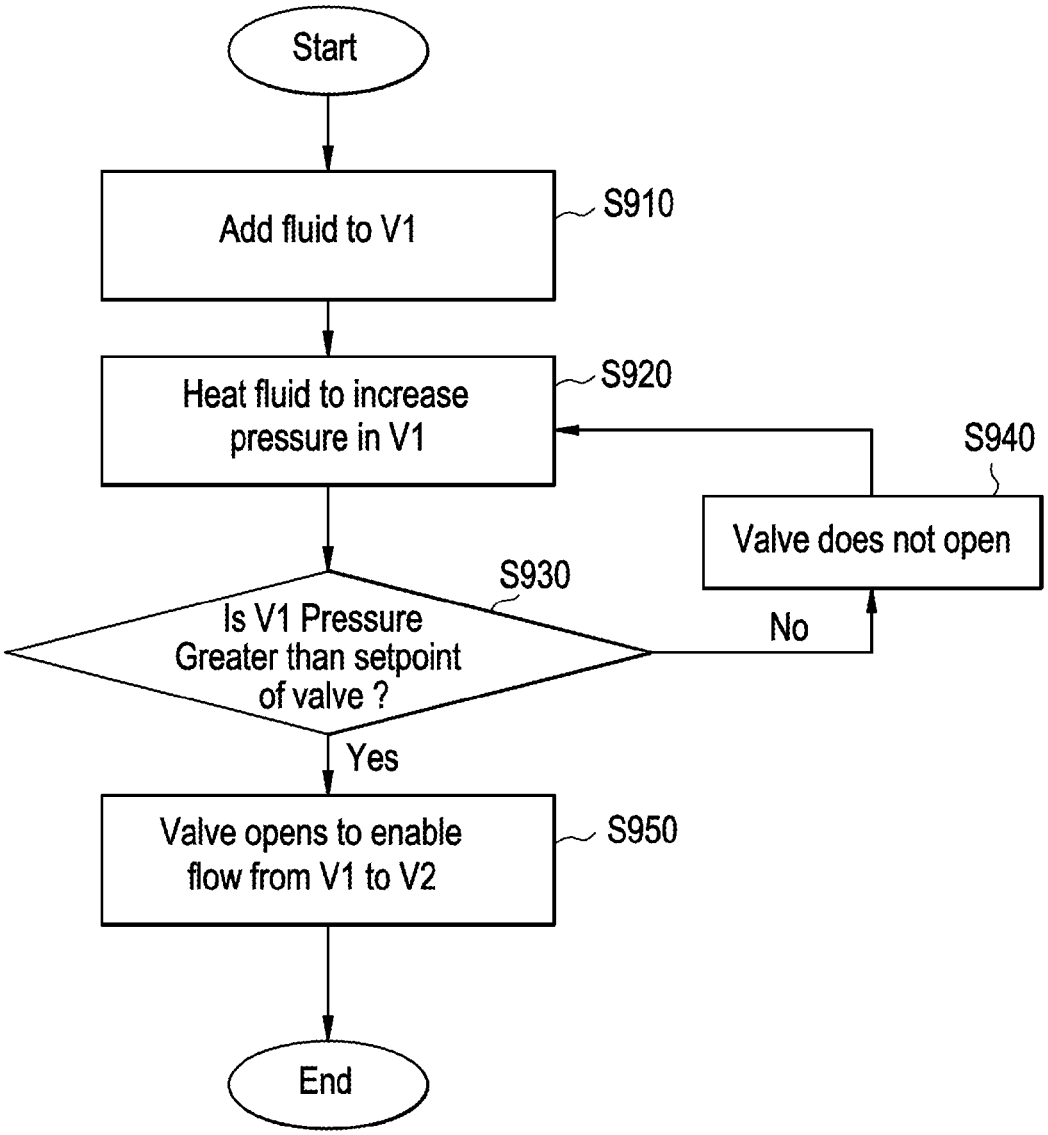
FIG. 9 is a flow chart illustrating a method of operating a thermal-pumping apparatus according to example embodiments.

FIG. 9 is a flow chart illustrating a method of operating a thermal-pumping apparatus according to example embodiments.

In operation S910, the fluid from a source may be added to a first control volume V1. For example, the fluid may be pumped to the first control volume V1. The fluid may be water, but is not limited thereto.

In operation S920, thermal energy may be transferred to the first control volume V1 in order to increase the pressure in the first control volume V1. For example, a heat exchanger and/or thermal collection device may be used to transfer thermal energy to the first control volume V1.

In operation S930, if the pressure of the fluid in the first control volume V1 is greater than the setpoint of a one-directional valve between the first and second control volumes V1 and V2, then the one-directional valve controlling flow between the first and second control volumes V1 and V2 may open. In other words, if the pressure of fluid in the first control volume V1 is greater than the pressure of fluid in the second control volume V2 and the differential pressure between the first and second control volumes V1 and V2 is greater than or equal to the set point of the one-directional valve, then the one-directional valve may open. Once the one-directional valve opens, fluid may flow from the first control volume V1 to the second control volume V2 according to operation S950.

Alternatively, as represented by operation S940, a one-directional valve controlling flow between the first and second control volumes V1 and V2 will not open if the pressure in the first control volume V1 is less than the pressure in the second control volume V2 and/or the differential pressure differential pressure between the first and second control volumes V1 and V2 is less than the set point of the one-directional valve. In this case, as shown in operation S920, additional thermal energy may be applied to the first control volume V1 in order to increase the pressure of the fluid V1.

According to example embodiments, a thermal-pumping apparatus may include first to Nth volume structures serially-connected to each other and one-directional valves for controlling fluid flow between adjacent volume structures among the first to Nth volume structures. N may be an integer greater than or equal 3. The one-directional valves may include a first one-directional valve between a first and second control volumes structures.

In an example embodiment, the thermal-pumping apparatus may be operated by thermally-pumping a fluid from the first volume structure through the first one-directional valve to the second volume structure, based on using thermal energy to active the first one-directional valve. Thermal energy may be used to increase a pressure of fluid in the first structure. The first one-directional valve may be opened if the pressure in the first volume structure is greater than a pressure in the second volume structure, and differential pressure between the first volume structure and the second volume structure is greater than or equal to a threshold of the first one-directional valve. The first one-directional valve may close if the differential pressure between the first and second volume structures is less than the threshold of the first one-directional valve, and/or the pressure in the first volume structure is less than the pressure in the second volume structure.

Thermally-pumping the fluid from the first volume structure through the first one-directional valve to the second volume structure may include thermally pumping at least one of a liquid phase of the fluid and a vapor phase from the first volume structure to the second volume structure. The fluid may be thermally-pumped from the second volume structure to the Nth volume structure, based on using thermal energy to activate the one-directional valves between the second volume structure and the Nth volume structure.

In thermal-pumping apparatuses according to some example embodiments, rejected heat from an industrial source (e.g., power plant) may provide the initial pumping or heat energy for transporting a fluid (e.g., water) through a plurality of control volumes serially connected to each other. With the exception of a pump used to convey the fluid into the first control volume of the plurality of control volumes, a thermal-pumping apparatus according to example embodiments may convey a fluid long distances (e.g., 1-10 miles or more) by only using the thermal energy of the sun or rejected industrial heat (e.g., from a steam cycle nuclear power plant), based on using a differential pressure control method to convey fluid. After the first control volume is filled with the fluid, subsequent volumes of the fluid may be heated and discharged into subsequent control volumes. The successive control volumes may move the fluid miles with no electrical power input or consumption used to increase a pressure of the fluid in the successive plurality of control volumes.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. A thermal-pumping apparatus, comprising:

a plurality of volume structures, the plurality of volume structures including a first volume structure and a second volume structure, the first volume structure defining a first volume, the first volume structure defining a first inlet opening and a first outlet opening in fluid communication with the first volume, the second volume structure defining a second volume, the second volume structure defining a second inlet opening and a second outlet opening in fluid communication with the second volume;

a plurality of connection structures connecting the plurality of volume structures in series such that each one of the plurality of connection structures connects a corresponding two adjacent volume structures among the plurality of volume structures, at least three of the plurality of volume structures being arranged end-to-end and extending laterally in a same direction, the at least three of the plurality of volume structures each having a length greater than a width and the same direction corresponding to the lengths of the at least three of the plurality of volume structures, the plurality of connection structures each including a one-directional valve configured to allow fluid flow between the corresponding two adjacent volume structures among the plurality of volume structures, the plurality of connection structures including a first connection structure joining the first outlet opening of the first volume structure to the second inlet opening of the second volume structure, the one-directional valve of the first connection structure configured to allow fluid flow between the first volume structure and the second volume structure in one direction only from the first volume of the first volume structure to the second volume of the second volume structure;

a heat transfer structure that is a closed system with respect to the first volume structure, the heat transfer structure being configured to transfer thermal energy to the first volume structure using at least one of conduction and radiation such that a pressure in the first volume structure increases; and a distributed control and information system (DCIS), the DCIS including a first volume structure sensor, a second volume structure sensor, and a connection structure sensor, the first volume structure sensor being configured to measure at least one of a temperature, a level, and a pressure of fluid in the first volume structure, the second volume structure sensor being configured to measure at least one of a temperature, a level, and a pressure of fluid in the second volume structure, the connection structure sensor being configured to measure a flow rate of fluid through the first connection structure.

2. The thermal-pumping apparatus of claim 1, further comprising:

at least one disc independently connected to a corresponding one of the first and second volume structures through a pipe portion and configured to relieve an internal pressure of the corresponding one of the first and second volume structures if the internal pressure of the corresponding one of the first and second volume structures bursts the disc.

3. The thermal-pumping apparatus of claim 1, wherein the first and second volume structures are pipes, the first connection structure is a flange joining one end of the first volume structure to one end of the second volume structure, the one-directional valve of the first connection structure is one of, surrounded by the first volume structure, surrounded by the second volume structure, and at an interface between the first and second volume structures.

4. The thermal-pumping apparatus of claim 1, further comprising at least one of an electrically-powered pump and a mechanically-powered pump that is not directly connected to the second volume structure and is not configured to increase a pressure in the second volume of the second volume structure.

5. The thermal-pumping apparatus of claim 1, wherein a bottom surface of the first volume structure defines the first outlet opening, the bottom surface of the first volume structure being opposite a top surface of the first volume structure, the first connection structure includes an equalizing line connected to the one-directional valve of the first connection structure and the second inlet opening of the second volume structure, the equalizing line is configured to allow fluid flow from the first volume of the first volume structure through the one-directional valve of the first connection structure to the second volume of the second volume structure if the one-directional valve is open such that the bottom surface of the first volume structure is in a primary flow path of fluid flow from the first volume of the first volume structure to the second volume of the second volume structure, and the connection structure sensor is configured to measure the flow rate of fluid through the equalizing line.

6. The thermal-pumping apparatus of claim 5, further comprising:

at least one exhaust valve connected to a corresponding one of the first volume structure and the second volume structure, wherein the corresponding one of the first volume structure and the second volume structure defines an exhaust opening that is spaced apart from a corresponding one of the first outlet opening and the second outlet opening in the corresponding one of the first volume structure and the second volume structure, the exhaust valve is connected to the exhaust opening, and the DCIS is configured to open the exhaust valve in order to provide a path for air or gas to escape from or enter the corresponding one of the first volume structure and the second volume structure.

7. The thermal-pumping apparatus of claim 5, further comprising:

a bypass valve, wherein the first volume structure defines a first bypass opening in fluid communication with the first volume, the equalizing line defines a first bypass hole, the bypass valve is connected to the first bypass opening and the first bypass hole, and the bypass valve is configured to selectively allow fluid flow from the first volume of the first volume structure through the first bypass hole into the equalizing line.

8. The thermal-pumping apparatus of claim 1, wherein the one-directional valve of the first connection structure is configured to open if a pressure of the first volume is greater than a pressure of the second volume, and a differential pressure between the first volume and the second volume is greater than or equal to a threshold of the one-directional valve of the first connection structure, the one-directional valve of the first connection structure is configured to close if the differential pressure between the first volume and the second volume is less than the threshold of the one-directional valve of the first connection structure, and the one-directional valve of the first connection structure is also configured to close if the pressure of the first volume is less than the pressure of the second volume.

9. The thermal-pumping apparatus of claim 1, further comprising:

at least one input pipe connected to the first inlet opening of the first volume structure.

10. The thermal-pumping apparatus of claim 9, wherein the plurality of volume structures and connection structures form a conduit, the plurality of connection structures connect at least 4 of the plurality of volume structures in series, and the conduit is configured to thermally-pump a fluid in the one direction only from the first volume structure through the plurality of connection structures to a terminal one of the plurality of volume structures, using at least one of conduction and radiation to develop differential pressures across the plurality of connection structures that transfer the fluid the one direction.

11. The thermal-pumping apparatus of claim 1, further comprising at least one of an electrically-powered pump and a mechanically-powered pump that is not directly connected to the second volume structure and is not configured to increase a pressure in the second volume of the second volume structure, the plurality of volume structures are a plurality of pipes, and the plurality of connection structures are flanges connecting the plurality of pipes end-to-end in series.

12. The thermal-pumping apparatus of claim 1, further comprising:

discs, wherein each one of the discs is independently connected to a corresponding one of the plurality of volume structures through respective pipe portions and is configured to relieve an internal pressure of the corresponding one of the plurality of volume structures if the internal pressure of the corresponding one of the plurality of volume structures bursts the one of the discs.

13. The thermal-pumping apparatus of claim 1, wherein the heat transfer structure is one of a heat exchanger, a thermal collection device, and a reflector.

14. The thermal-pumping apparatus of claim 1, further comprising:

an input pipe, wherein a first end of the input pipe is connected to the first inlet opening of the first volume structure, a pump connected to a second end of the input pipe, the pump is configured to be electrically-powered or mechanically-powered, and the pump is configured to supply a fluid from a fluid source structure to the input pipe for delivering the fluid to the first volume structure.

15. A method of manufacturing a thermal-pumping apparatus comprising:

connecting a plurality of volume structures to each other in series using a plurality of connection structures having one-direction valves such that each one of the plurality of connection structures connects a corresponding two adjacent volume structures among the plurality of volume structures, at least three of the plurality of volume structures being arranged end-to-end and extending laterally in a same direction, the at least three of the plurality of volume structures each having a length greater than a width and the same direction corresponding to the lengths of the at least three of the plurality of volume structures, the connecting the plurality of volume structures including connecting a first volume structure to a second volume structure among the plurality of volume structures with a first connection structure among the plurality of connection structures, the first volume structure defining a first volume, the first volume structure defining a first inlet opening and a first outlet opening in fluid communication with the first volume, the second volume structure defining a second volume, the second volume structure defining a second inlet opening and a second outlet opening in fluid communication with the second volume, the first connection structure joining the first outlet opening of the first volume structure to the second inlet opening of the second volume structure, and the first connection structure including a one-directional valve configured to allow fluid flow between the first volume structure and the second volume structure in one direction only from the first volume of the first volume structure to the second volume of the second volume structure;

connecting a heat transfer structure to a corresponding one of the first volume structure and the second volume structures, the heat transfer structure being a closed system with respect to the corresponding one of the first volume structure and the second volume structure, the heat transfer structure being configured to transfer thermal energy to a corresponding one of the first volume structure and the second volume structure using at least one of conduction and radiation such that a pressure in the corresponding one of the first volume structure and the second volume structure increases; and connecting a distributed control and information system (DCIS) to the first volume structure, the first connection structure, and the second volume structure, the DCIS including first volume structure sensor, a second volume structure sensor, and a connection structure sensor, the first volume structure sensor being configured to measure at least one of a temperature, a level, and a pressure of fluid in the first volume structure, the second volume structure sensor being configured to measure at least one of a temperature, a level, and a pressure of fluid in the second volume structure, and the first connection structure sensor is configured to measure a flow rate of fluid through the first connection structure.

16. The method of claim 15, further comprising:

connecting a disc to the corresponding one of the first volume structure and the second volume structure, wherein the disc is connected to the corresponding one of the first volume structure and the second volume structure through a pipe portion, the disc is configured to relieve an internal pressure of the corresponding one of the first volume structure and the second volume structure if the internal pressure of the corresponding one of the volume structure and the second volume structure bursts the disc.

17. The method of claim 15, wherein each one of the one-directional valves of the plurality of connection structures is one of surrounded by a corresponding one of the plurality connection structures and at an interface between two of the plurality of connection structures, and at least one of an electrically-powered pump and a mechanically-powered pump is provided and is not directly connected to the first volume structure and is not configured to increase a pressure in the first volume of the first volume structure.

18. The method of claim 15, wherein a bottom surface of the first volume structure defines the first outlet opening, the first connection structure includes an equalizing line, the connecting the plurality of connection structures includes connecting the equalizing line to the one-directional valve of the first connection structure and the second inlet opening of the second volume structure, the equalizing line is configured to allow fluid flow from the first volume of the first volume structure through the one-directional valve of the first connection structure to the second volume of the second volume structure if the one-directional valve of the first connection structure is open, the first connection structure sensor is configured to measure the flow rate of fluid through the equalizing line.

19. A method of operating a thermal-pumping apparatus including first to Nth volume structures serially-connected to each other, a heat transfer structure configured to transfer thermal energy to the first volume structure such that a pressure inside the first volume structure increases, and respective one-directional valves controlling fluid flow between adjacent volume structures, the one-directional valves including a first one-directional valve between the first and second volume structures, the method comprising:

thermally-pumping a fluid from the first volume structure through the first one-directional valve to the second volume structure, based on transferring thermal energy from the heat transfer structure to the first volume structure using at least one of conduction and radiation to activate the first one-directional valve, the heat transfer structure being a closed system with respect to the first volume structure, the thermally-pumping the fluid including thermally pumping a mixed liquid and vapor phase of the fluid through the first and second volume structures, wherein the thermal-pumping apparatus includes a distributed control and information system (DCIS), the DCIS including a first volume structure sensor, a second volume structure sensor, and a connection structure sensor, the first volume structure sensor being configured to measure at least one of a temperature, a level, and a pressure of fluid in the first volume structure, the second volume structure sensor being configured to measure at least one of a temperature, a level, and a pressure of fluid in the second volume structure, the connection structure sensor being configured to measure a flow rate of fluid through the first one-directional valve.

20. The method of claim 19, wherein the thermally-pumping includes:

increasing the pressure in the first volume structure using the thermal energy;

opening the first one-directional valve if the pressure in the first volume structure is greater than a pressure in the second volume structure, and a differential pressure between the first volume structure and the second volume structure is greater than or equal to a threshold of the first one-directional valve; and closing the first one-directional valve if at least one of, the differential pressure between the first and second volume structures is less than the threshold of the first one-directional valve, and the pressure in the first volume structure is less than the pressure in the second volume structure.

21. The method of claim 19, further comprising:

thermally pumping the fluid from the second volume structure to the Nth volume structure based on using thermal energy to activate the one-directional valves between the second volume structure and the Nth volume structure.

* * * * *